US010874997B2

(12) United States Patent
Weitz et al.

(10) Patent No.: US 10,874,997 B2
(45) Date of Patent: Dec. 29, 2020

(54) MULTIPLE EMULSIONS CREATED USING JETTING AND OTHER TECHNIQUES

(71) Applicant: President and Fellows of Harvard College, Cambridge, MA (US)

(72) Inventors: David A. Weitz, Bolton, MA (US); Julian W. P. Thiele, Dresden (DE); Adam R. Abate, Daly City, CA (US)

(73) Assignee: President and Fellows of Harvard College, Cambridge, MA (US)

( * ) Notice: Subject to any disclaimer, the term of this patent is extended or adjusted under 35 U.S.C. 154(b) by 70 days.

(21) Appl. No.: 15/656,415

(22) Filed: Jul. 21, 2017

(65) Prior Publication Data

US 2018/0071695 A1 Mar. 15, 2018

Related U.S. Application Data

(63) Continuation of application No. 13/388,596, filed as application No. PCT/US2010/047467 on Sep. 1, 2010, now abandoned.

(Continued)

(51) Int. Cl.
*B01F 3/08* (2006.01)
*B01F 13/00* (2006.01)

(52) U.S. Cl.
CPC ..... *B01F 3/0807* (2013.01); *B01F 13/0062* (2013.01); *B01F 13/0084* (2013.01);
(Continued)

(58) Field of Classification Search
CPC ..... B01F 13/0059–0096; B01F 2003/0823–0849; B01F 3/0807–0819
See application file for complete search history.

(56) References Cited

U.S. PATENT DOCUMENTS 2,379,816 A 7/1945 Mabbs
2,918,263 A 12/1959 Eichhorn
(Continued)

FOREIGN PATENT DOCUMENTS

CA 2 767 056 A1 3/2011
CH 563807 A5 7/1975
(Continued)

OTHER PUBLICATIONS

Machine Translation of CN1908658A. Feb. 7, 2007 (Year: 2007).*
(Continued)

*Primary Examiner* — Stephen E Rieth
(74) *Attorney, Agent, or Firm* — Wolf, Greenfield & Sacks, P.C.

(57) ABSTRACT

The present invention generally relates to emulsions, and more particularly, to multiple emulsions. In one aspect, multiple emulsions are formed by urging a fluid into a channel, e.g., by causing the fluid to enter the channel as a "jet." Multiple fluids may flow through a channel collinearly before multiple emulsion droplets are formed. The fluidic channels may also, in certain embodiments, include varying degrees of hydrophilicity or hydrophobicity. In some cases, the average cross-sectional dimension may change, e.g., at an intersection. Unexpectedly, systems such as those described herein may be used to encapsulate fluids in single or multiple emulsions that are difficult or impossible to encapsulate using other techniques, such as fluids with low surface tension, viscous fluids, or viscoelastic fluids. Other aspects of the invention are generally directed to methods of making and using such systems, kits involving such systems, emulsions created using such systems, or the like.

19 Claims, 7 Drawing Sheets

Related U.S. Application Data

(60) Provisional application No. 61/353,093, filed on Jun. 9, 2010, provisional application No. 61/239,405, filed on Sep. 2, 2009.

(52) U.S. Cl.
CPC . *B01F 2003/0838* (2013.01); *B01F 2215/045* (2013.01); *B01F 2215/0459* (2013.01); *Y10T 137/0318* (2015.04); *Y10T 137/85938* (2015.04)

(56) References Cited

U.S. PATENT DOCUMENTS 3,505,244 A 4/1970 Cessna
3,675,901 A 7/1972 Rion
3,816,331 A 6/1974 Brown et al.
3,980,541 A 9/1976 Aine
4,251,195 A 2/1981 Suzuki et al.
4,279,345 A 7/1981 Allred
4,422,985 A 12/1983 Morishita et al.
4,508,265 A 4/1985 Jido
4,695,466 A 9/1987 Morishita et al.
4,732,930 A 3/1988 Tanaka et al.
4,743,507 A 5/1988 Franses et al.
4,865,444 A 9/1989 Green et al.
4,880,313 A 11/1989 Loquenz et al.
4,888,140 A 12/1989 Schlameus et al.
4,931,225 A 6/1990 Cheng
4,978,483 A 12/1990 Redding, Jr.
4,996,265 A 2/1991 Okubo et al.
5,100,933 A 3/1992 Tanaka et al.
5,149,625 A 9/1992 Church et al.
5,204,112 A 4/1993 Hope et al.
5,209,978 A 5/1993 Kosaka et al.
5,216,096 A 6/1993 Hattori et al.
5,232,712 A 8/1993 Mills et al.
5,326,692 A 7/1994 Brinkley et al.
5,378,957 A 1/1995 Kelly
5,418,154 A 5/1995 Aebischer et al.
5,452,955 A 9/1995 Lundstrom
5,500,223 A 3/1996 Behan et al.
5,512,131 A 4/1996 Kumar et al.
5,617,997 A 4/1997 Kobayashi et al.
5,681,600 A 10/1997 Antinone et al.
5,762,775 A 6/1998 DePaoli et al.
5,795,590 A 8/1998 Kiefer et al.
5,849,055 A 12/1998 Arai et al.
5,851,769 A 12/1998 Gray et al.
5,882,680 A 3/1999 Suzuki et al.
5,888,538 A 3/1999 Kiefer et al.
5,935,331 A 8/1999 Naka et al.
5,942,443 A 8/1999 Parce et al.
5,980,936 A 11/1999 Krafft et al.
6,004,525 A 12/1999 Tani et al.
6,046,056 A 4/2000 Parce et al.
6,116,516 A 9/2000 Ganan-Calvo
6,119,953 A 9/2000 Ganan-Calvo et al.
6,120,666 A 9/2000 Jacobson et al.
6,149,789 A 11/2000 Benecke et al.
6,150,180 A 11/2000 Parce et al.
6,174,469 B1 1/2001 Ganan-Calvo
6,187,214 B1 2/2001 Ganan-Calvo
6,189,803 B1 2/2001 Ganan-Calvo
6,193,951 B1 2/2001 Ottoboni et al.
6,196,525 B1 3/2001 Ganan-Calvo
6,197,835 B1 3/2001 Ganan-Calvo
6,221,654 B1 4/2001 Quake et al.
6,234,402 B1 5/2001 Ganan-Calvo
6,238,690 B1 5/2001 Kiefer et al.
6,241,159 B1 6/2001 Ganan-Calvo et al.
6,248,378 B1 6/2001 Ganan-Calvo
6,251,661 B1 6/2001 Urabe et al.
6,267,858 B1 7/2001 Parce et al.
6,274,337 B1 8/2001 Parce et al.
6,299,145 B1 10/2001 Ganan-Calvo
6,301,055 B1 10/2001 Legrand et al.
6,306,659 B1 10/2001 Parce et al.
6,355,198 B1 3/2002 Kim et al.
6,357,670 B2 3/2002 Ganan-Calvo
6,380,297 B1 4/2002 Zion et al.
6,386,463 B1 5/2002 Ganan-Calvo
6,394,429 B2 5/2002 Ganan-Calvo
6,399,389 B1 6/2002 Parce et al.
6,405,936 B1 6/2002 Ganan-Calvo
6,408,878 B2 6/2002 Unger et al.
6,429,025 B1 8/2002 Parce et al.
6,432,148 B1 8/2002 Ganan-Calvo
6,432,630 B1 8/2002 Blankenstein
6,450,189 B1 9/2002 Ganan-Calvo
6,464,886 B2 10/2002 Ganan-Calvo
6,489,103 B1 12/2002 Griffiths et al.
6,506,609 B1 1/2003 Wada et al.
6,508,988 B1 1/2003 Van Dam et al.
6,524,456 B1 2/2003 Ramsey et al.
6,540,895 B1 4/2003 Spence et al.
6,554,202 B2 4/2003 Ganan-Calvo
6,557,834 B2 5/2003 Ganan-Calvo
6,558,944 B1 5/2003 Parce et al.
6,558,960 B1 5/2003 Parce et al.
6,560,030 B2 5/2003 Legrand et al.
6,592,821 B1 7/2003 Wada et al.
6,608,726 B2 8/2003 Legrand et al.
6,610,499 B1 8/2003 Fulwyler et al.
6,614,598 B1 9/2003 Quake et al.
6,630,353 B1 10/2003 Parce et al.
6,645,432 B1 11/2003 Anderson et al.
6,660,252 B2 12/2003 Matathia et al.
6,752,922 B2 7/2004 Huang et al.
6,790,328 B2 9/2004 Jacobson et al.
6,806,058 B2 10/2004 Jesperson et al.
6,890,487 B1 5/2005 Sklar et al.
6,935,768 B2 8/2005 Lowe et al.
7,041,481 B2 5/2006 Anderson et al.
7,068,874 B2 6/2006 Wang et al.
7,115,230 B2 10/2006 Sundararajan et al.
7,268,167 B2 9/2007 Higuchi et al.
7,374,332 B2 5/2008 Higashino et al.
7,378,473 B2 5/2008 Torii et al.
7,638,276 B2 12/2009 Griffiths et al.
7,651,770 B2 1/2010 Berkland et al.
7,708,949 B2 5/2010 Stone et al.
7,776,927 B2 8/2010 Chu et al.
RE41,780 E 9/2010 Anderson et al.
7,968,287 B2 6/2011 Griffiths et al.
8,252,539 B2 8/2012 Quake et al.
8,273,573 B2 9/2012 Ismagilov et al.
8,278,071 B2 10/2012 Brown et al.
8,302,880 B2 11/2012 Clarke
8,329,407 B2 12/2012 Ismagilov et al.
8,439,487 B2 5/2013 Clarke et al.
8,685,323 B2 4/2014 Nam et al.
8,696,952 B2 4/2014 Kumacheva et al.
8,697,008 B2 4/2014 Clarke et al.
8,741,192 B2 6/2014 Torii et al.
8,748,102 B2 6/2014 Berka et al.
8,765,380 B2 7/2014 Berka et al.
8,772,046 B2 7/2014 Fraden et al.
8,871,444 B2 10/2014 Griffiths et al.
9,039,273 B2 5/2015 Weitz et al.
9,238,206 B2 1/2016 Rotem et al.
9,573,099 B2 2/2017 Weitz et al.
10,316,873 B2 6/2019 Weitz et al.
2002/0004532 A1 1/2002 Matathia et al.
2002/0008028 A1 1/2002 Jacobson et al.
2002/0009473 A1 1/2002 Tebbe
2002/0119459 A1 8/2002 Griffiths
2003/0015425 A1 1/2003 Bohm et al.
2003/0039169 A1 2/2003 Ehrfeld et al.
2003/0077204 A1 4/2003 Seki et al.
2003/0124509 A1 7/2003 Kenis et al.
2003/0124586 A1 7/2003 Griffiths et al.
2003/0180485 A1 9/2003 Nakajima et al.
2003/0227820 A1 12/2003 Parrent

(56) References Cited

U.S. PATENT DOCUMENTS

| | | | |
|---|---|---|---|
| 2004/0058198 | A1 | 3/2004 | Wang et al. |
| 2004/0068019 | A1 | 4/2004 | Higuchi et al. |
| 2004/0096515 | A1 | 5/2004 | Bausch et al. |
| 2004/0182712 | A1 | 9/2004 | Basol |
| 2004/0266022 | A1 | 12/2004 | Sundararajan et al. |
| 2005/0032238 | A1 | 2/2005 | Karp et al. |
| 2005/0032240 | A1 | 2/2005 | Lee et al. |
| 2005/0172476 | A1 | 8/2005 | Stone et al. |
| 2005/0183995 | A1 | 8/2005 | Deshpande et al. |
| 2005/0207940 | A1 | 9/2005 | Butler et al. |
| 2005/0221339 | A1 | 10/2005 | Griffiths et al. |
| 2006/0014894 | A1 | 1/2006 | Torii et al. |
| 2006/0051329 | A1 | 3/2006 | Lee et al. |
| 2006/0078888 | A1 | 4/2006 | Griffiths et al. |
| 2006/0078893 | A1 | 4/2006 | Griffiths et al. |
| 2006/0108012 | A1 | 5/2006 | Barrow et al. |
| 2006/0153924 | A1 | 7/2006 | Griffiths et al. |
| 2006/0163385 | A1 | 7/2006 | Link et al. |
| 2006/0196644 | A1 | 9/2006 | Boger et al. |
| 2006/0263888 | A1 | 11/2006 | Fritz et al. |
| 2007/0000342 | A1 | 1/2007 | Kazuno |
| 2007/0003442 | A1 | 1/2007 | Link et al. |
| 2007/0009668 | A1 | 1/2007 | Wyman et al. |
| 2007/0054119 | A1 | 3/2007 | Garstecki et al. |
| 2007/0056853 | A1 | 3/2007 | Aizenberg et al. |
| 2007/0092914 | A1 | 4/2007 | Griffiths et al. |
| 2007/0172827 | A1 | 7/2007 | Murakami |
| 2007/0172873 | A1 | 7/2007 | Brenner et al. |
| 2007/0195127 | A1 | 8/2007 | Ahn et al. |
| 2007/0196397 | A1 | 8/2007 | Torii et al. |
| 2008/0003142 | A1 | 1/2008 | Link et al. |
| 2008/0004436 | A1 | 1/2008 | Tawfik et al. |
| 2008/0014589 | A1 | 1/2008 | Link et al. |
| 2009/0012187 | A1 | 1/2009 | Chu et al. |
| 2009/0068170 | A1 | 3/2009 | Weitz et al. |
| 2009/0131543 | A1 | 5/2009 | Weitz et al. |
| 2009/0191276 | A1 | 7/2009 | Kim et al. |
| 2009/0197772 | A1 | 8/2009 | Griffiths et al. |
| 2009/0235990 | A1 | 9/2009 | Beer |
| 2009/0286687 | A1 | 11/2009 | Dressman et al. |
| 2010/0096088 | A1 | 4/2010 | Okita et al. |
| 2010/0129422 | A1 | 5/2010 | Han et al. |
| 2010/0130369 | A1 | 5/2010 | Shenderov et al. |
| 2010/0136544 | A1 | 6/2010 | Agresti et al. |
| 2010/0137163 | A1 | 6/2010 | Link et al. |
| 2010/0163109 | A1 | 7/2010 | Fraden et al. |
| 2010/0170957 | A1 | 7/2010 | Clarke |
| 2010/0173394 | A1 | 7/2010 | Colston, Jr. et al. |
| 2010/0188466 | A1 | 7/2010 | Clarke |
| 2010/0210479 | A1 | 8/2010 | Griffiths et al. |
| 2010/0213628 | A1 | 8/2010 | Bausch et al. |
| 2010/0238232 | A1 | 9/2010 | Clarke et al. |
| 2011/0086780 | A1 | 4/2011 | Colston, Jr. et al. |
| 2011/0092392 | A1 | 4/2011 | Colston, Jr. et al. |
| 2011/0116993 | A1 | 5/2011 | Nam et al. |
| 2011/0123413 | A1 | 5/2011 | Abate et al. |
| 2011/0129941 | A1 | 6/2011 | Kumacheva et al. |
| 2011/0160078 | A1 | 6/2011 | Fodor et al. |
| 2011/0229545 | A1 | 9/2011 | Shum et al. |
| 2011/0305761 | A1 | 12/2011 | Shum et al. |
| 2012/0010107 | A1 | 1/2012 | Griffiths et al. |
| 2012/0015382 | A1 | 1/2012 | Weitz et al. |
| 2012/0048882 | A1 | 3/2012 | Clarke et al. |
| 2012/0053250 | A1 | 3/2012 | Carrick et al. |
| 2012/0108721 | A1 | 5/2012 | Mazutis |
| 2012/0168010 | A1 | 7/2012 | Bauer et al. |
| 2012/0190032 | A1 | 7/2012 | Ness et al. |
| 2012/0199226 | A1 | 8/2012 | Weitz et al. |
| 2012/0211084 | A1 | 8/2012 | Weitz et al. |
| 2012/0220494 | A1 | 8/2012 | Samuels et al. |
| 2012/0220497 | A1 | 8/2012 | Jacobson et al. |
| 2013/0046030 | A1 | 2/2013 | Rotem et al. |
| 2013/0064862 | A1 | 3/2013 | Weitz et al. |
| 2013/0079231 | A1 | 3/2013 | Pushkarev et al. |
| 2013/0109575 | A1 | 5/2013 | Kleinschmidt et al. |
| 2013/0157899 | A1 | 6/2013 | Adler, Jr. et al. |
| 2013/0210639 | A1 | 8/2013 | Link et al. |
| 2013/0274117 | A1 | 10/2013 | Church et al. |
| 2013/0277461 | A1 | 10/2013 | Ripoll et al. |
| 2013/0323764 | A1 | 12/2013 | Nicholls et al. |
| 2014/0024023 | A1 | 1/2014 | Cauley et al. |
| 2014/0065234 | A1 | 3/2014 | Shum et al. |
| 2014/0151912 | A1 | 6/2014 | Nam et al. |
| 2014/0155295 | A1 | 6/2014 | Hindson et al. |
| 2014/0220350 | A1 | 8/2014 | Kim et al. |
| 2014/0227684 | A1 | 8/2014 | Hindson et al. |
| 2014/0235506 | A1 | 8/2014 | Hindson et al. |
| 2014/0378349 | A1 | 12/2014 | Hindson et al. |
| 2015/0005200 | A1 | 1/2015 | Hindson et al. |
| 2015/0285285 | A1 | 10/2015 | Weitz et al. |
| 2016/0193574 | A1 | 7/2016 | Weitz et al. |

FOREIGN PATENT DOCUMENTS

| | | | | |
|---|---|---|---|---|
| CN | 1695809 | A | | 11/2005 |
| CN | 1772363 | A | | 5/2006 |
| CN | 1908658 | A | * | 2/2007 |
| CN | 1933898 | A | | 3/2007 |
| CN | 101721964 | A | | 6/2010 |
| CN | 101856603 | A | | 10/2010 |
| CN | 102014871 | A | | 4/2011 |
| DE | 43 08 839 | A1 | | 9/1994 |
| DE | 199 61 257 | A1 | | 7/2001 |
| DE | 100 15 109 | A1 | | 10/2001 |
| DE | 100 41 823 | A1 | | 3/2002 |
| DE | 102005048259.00 | A1 | | 4/2007 |
| EP | 0 249 007 | A2 | | 12/1987 |
| EP | 0 272 659 | A2 | | 6/1988 |
| EP | 0 478 326 | A1 | | 4/1992 |
| EP | 0 718 038 | B1 | | 10/2002 |
| EP | 1 362 634 | A1 | | 11/2003 |
| EP | 1358931 | A2 | | 11/2003 |
| EP | 1019496 | B1 | | 9/2004 |
| EP | 1595597 | A2 | | 11/2005 |
| EP | 1 757 357 | A1 | | 2/2007 |
| EP | 1482036 | B1 | | 10/2007 |
| EP | 1 741 482 | A2 | | 1/2008 |
| EP | 1594980 | B1 | | 11/2009 |
| EP | 1967592 | B1 | | 4/2010 |
| EP | 2258846 | A2 | | 12/2010 |
| EP | 2 283 918 | A2 | | 2/2011 |
| EP | 2283918 | A2 | | 2/2011 |
| EP | 2 289 613 | A2 | | 3/2011 |
| EP | 2145955 | B1 | | 2/2012 |
| EP | 1905828 | B1 | | 8/2012 |
| EP | 1908832 | B1 | | 12/2012 |
| EP | 2540389 | A1 | | 1/2013 |
| EP | 1 757 357 | A1 | | 4/2013 |
| FR | 2696658 | A1 | | 4/1994 |
| GB | 1 422 737 | | | 1/1976 |
| GB | 1 446 998 | | | 8/1976 |
| GB | 2 433 448 | A | | 6/2007 |
| JP | S54-107880 | A | | 8/1979 |
| JP | S56-130219 | A | | 10/1981 |
| JP | S60-040055 | A | | 3/1985 |
| JP | H10-219222 | A | | 8/1998 |
| JP | H11-509768 | A | | 8/1999 |
| JP | 2004-202476 | A | | 7/2004 |
| JP | 2004-351417 | A | | 12/2004 |
| JP | 2005-144356 | A | | 6/2005 |
| JP | 2005-152740 | A | | 6/2005 |
| JP | 2005-152773 | A | | 6/2005 |
| JP | 2005-288254 | A | | 10/2005 |
| JP | 2006-504512 | A | | 2/2006 |
| JP | 2006-507921 | A | | 3/2006 |
| JP | 2006-523142 | A | | 10/2006 |
| JP | 2008-073581 | A | | 4/2008 |
| JP | 2008-535644 | A | | 9/2008 |
| JP | 2008-238146 | A | | 10/2008 |
| JP | 2010-000428 | A | | 1/2010 |
| JP | 2011-041925 | A | | 3/2011 |
| JP | 5108875 | B2 | | 12/2012 |
| WO | WO 96/29629 | A2 | | 9/1996 |
| WO | WO 00/70080 | A1 | | 11/2000 |

(56) References Cited

FOREIGN PATENT DOCUMENTS

| | | | |
|---|---|---|---|
| WO | WO 00/76673 | A1 | 12/2000 |
| WO | WO 01/12327 | A1 | 2/2001 |
| WO | WO 01/68257 | A1 | 9/2001 |
| WO | WO 01/69289 | A2 | 9/2001 |
| WO | WO 01/72431 | A1 | 10/2001 |
| WO | WO 01/85138 | A2 | 11/2001 |
| WO | WO 01/89787 | A2 | 11/2001 |
| WO | WO 01/89788 | A2 | 11/2001 |
| WO | WO 01/94635 | A2 | 12/2001 |
| WO | WO 02/18949 | A2 | 3/2002 |
| WO | WO 02/047665 | A2 | 6/2002 |
| WO | WO 02/068104 | A1 | 9/2002 |
| WO | WO 02/103011 | A2 | 12/2002 |
| WO | WO 03/011443 | A2 | 2/2003 |
| WO | WO 03/068381 | A1 | 8/2003 |
| WO | WO 2004/002627 | A2 | 1/2004 |
| WO | WO 2004/038363 | A2 | 5/2004 |
| WO | WO 2004/052941 | A1 | 6/2004 |
| WO | WO 2004/071638 | A2 | 8/2004 |
| WO | WO 2004/091763 | A2 | 10/2004 |
| WO | WO 2005/002730 | A1 | 1/2005 |
| WO | WO 2005/021151 | A1 | 3/2005 |
| WO | WO 2005/049787 | A2 | 6/2005 |
| WO | WO 2005/084210 | A2 | 9/2005 |
| WO | WO 2005/089921 | A1 | 9/2005 |
| WO | WO 2005/103106 | A1 | 11/2005 |
| WO | WO 2006/002641 | A1 | 1/2006 |
| WO | WO 2006/078841 | A1 | 7/2006 |
| WO | WO 2006/096571 | A2 | 9/2006 |
| WO | WO 2006/101851 | A2 | 9/2006 |
| WO | WO 2007/001448 | A2 | 1/2007 |
| WO | WO 2007/024410 | A2 | 3/2007 |
| WO | WO 2007/081385 | A2 | 7/2007 |
| WO | WO 2007/089541 | A2 | 8/2007 |
| WO | WO 2007/133807 | A2 | 11/2007 |
| WO | WO 2008/058297 | A2 | 5/2008 |
| WO | WO 2008/109176 | A2 | 9/2008 |
| WO | WO 2008/121342 | A2 | 10/2008 |
| WO | WO 2008/134153 | A1 | 11/2008 |
| WO | WO 2009/000084 | A1 | 12/2008 |
| WO | WO 2009/020633 | A2 | 2/2009 |
| WO | WO 2009/048532 | A2 | 4/2009 |
| WO | WO 2009/061372 | A1 | 5/2009 |
| WO | WO 2009/075652 | A1 | 6/2009 |
| WO | WO 2009/120254 | A1 | 10/2009 |
| WO | WO 2010/104597 | A2 | 9/2010 |
| WO | WO 2010/104604 | A1 | 9/2010 |
| WO | WO 2010/121307 | A1 | 10/2010 |
| WO | WO 2010/146261 | A2 | 12/2010 |
| WO | WO 2011/001185 | A2 | 1/2011 |
| WO | WO 2011/028760 | A2 | 3/2011 |
| WO | WO 2011/028764 | A2 | 3/2011 |
| WO | WO 2012/048341 | A1 | 4/2012 |
| WO | WO 2013/177220 | | 11/2013 |

OTHER PUBLICATIONS

Utada et al. Dripping to jetting transitions in coflowing liquid streams. Physical Review Letters. 2007, 99, 094502-1 to 094502-4. (Year: 2007).*

Gao, H-W et al. Rheological behaviors of PVA/H2O solutions of high-polymer concentration. Journal of Applied Polymer Science, 2010, 116, 1459-1466. (Year: 2010).*

Atencia, J., Beebe, D. J. Controlled microfluidic interfaces. Nature, 2005, 437, 648-655. (Year: 2005).*

Examination Report for Application No. 1874/DELNP/2012 dated Jun. 20, 2018.

Office Action dated Feb. 23, 2018 for Application No. KR 10-2012-7008201.

European Office Action dated Aug. 9, 2018 for Application No. 10814401.5.

Harvey, The surface tension of crude oils. Industrial and Engineering Chemistry.Jan. 1, 1925; p. 85.

European Office Communication for EP 06737002.3 dated Apr. 3, 2008.

European Office Communication for EP 06737002.3 dated Mar. 11, 2009.

Examining Division Decision for EP 06737002.3 dated Sep. 2, 2010.

Extended European Search Report for EP 10165813.6 dated Oct. 7, 2010.

Invitation to Pay Additional Fees for PCT/US2006/007772 dated Jun. 28, 2006.

International Search Report and Written Opinion for PCT/US2006/007772 dated Sep. 1, 2006.

International Preliminary Report on Patentability for PCT/US2006/007772 dated Sep. 20, 2007.

Decision on Rejection for CN 200880017845.4 dated Sep. 24, 2012.

International Search Report and Written Opinion for PCT/US2008/004097 dated Aug. 10, 2009.

European Office Action for Application No. EP 09758762.0 dated Aug. 13, 2015.

Korean Office Action for Application No. KR 10-2011-7000094 dated Feb. 27, 2013.

International Search Report and Written Opinion for International Application No. PCT/US09/003389 dated Oct. 21, 2009.

International Preliminary Report on Patentability for International Application No. PCT/US2009/003389 dated Dec. 16, 2010.

International Search Report and Written Opinion for International Application No. PCT/US2001/46181 dated Mar. 12, 2003.

International Preliminary Examination Report for International Application No. PCT/US2001/46181 dated Apr. 5, 2004.

International Search Report International Search Report and Written Opinion for International Application No. PCT/US2007/084561 dated Apr. 29, 2008.

International Search Report and Written Opinion for PCT/US2010/000763 dated Jul. 20, 2010.

Chinese Office Action for Application No. CN 201080039018.2 dated Sep. 27, 2013.

Chinese Office Action dated May 13, 2014 for Application No. 201080039018.2.

Chinese Office Action dated Sep. 17, 2014 for Application No. 201080039018.2.

Extended European Search Report for Application No. EP 10814398.3 dated Oct. 29, 2015.

Japanese Office Action dated Aug. 5, 2014 for Application No. JP 2012-527993.

International Search Report and Written Opinion for PCT/US2010/047458 dated May 24, 2011.

International Preliminary Report on Patentability for PCT/US2010/047458 dated Mar. 15, 2012.

Chinese Office Action for Application No. CN 201080039023.3 dated Dec. 23, 2013.

Chinese Office Action dated Oct. 24, 2014 for Application No. 201080039023.3.

Chinese Office Action dated Jul. 10, 2015 for Application No. 201080039023.3.

Extended European Search Report for Application No. EP 10814401.5 dated Nov. 3, 2015.

European Office Communication for EP 10814401.5 dated Nov. 10, 2016.

Japanese Office Action dated Jul. 22, 2014 for Application No. JP 2012-527995.

Japanese Office Action dated Jun. 11, 2015 for Application No. 2012-527995.

Korean Office Action dated Aug. 5, 2016 for Application No. KR 10-2012-7008201.

Office Action dated Feb. 16, 2017 for Application No. KR 10-2012-7008201.

Office Action dated Apr. 10, 2017 for Application No. KR 10-2012-7008201.

International Search Report and Written Opinion for PCT/US2010/047467 dated May 26, 2011.

International Preliminary Report on Patentability for PCT/US2010/047467 dated Mar. 15, 2012.

(56) References Cited

OTHER PUBLICATIONS

Chinese Office Action dated May 13, 2014 for Application No. CN 201180014139.6.
Invitation to Pay Additional Fees for PCT/US2011/028754 dated Nov. 30, 2011.
International Search Report and Written Opinion for PCT/US2011/028754 dated Apr. 3, 2012.
International Preliminary Report on Patentability for PCT/US2011/028754 dated Sep. 27, 2012.
Chinese Office Action dated Jan. 16, 2015 for Application No. CN 201280024857.6.
Chinese Office Action for Application No. CN 201280024857.6 dated Sep. 14, 2015.
European Office Action dated Mar. 24, 2015 for Application No. 12725967.9.
European Office Action for Application No. 12725967.9 dated Nov. 19, 2015.
Japanese Office Action for Application No. JP 2014-512944 dated Mar. 15, 2016.
Japanese Office Action dated Nov. 29, 2016 for Application No. JP 2014-512944.
Invitation to Pay Additional Fees for PCT/US2012/038957 dated Sep. 5, 2012.
International Search Report and Written Opinion for PCT/US2012/038957 dated Dec. 13, 2012.
International Preliminary Report on Patentability for PCT/US2012/038957 dated Dec. 5, 2013.
Chinese Office Action for Application No. CN 201280039927.5 dated Mar. 24, 2015.
Chinese Office Action for Application No. CN 201280039927.5 dated Dec. 1, 2015.
European Office Action dated Feb. 12, 2015 for Application No. 12736019.6.
European Office Action dated Oct. 7, 2015 for Application No. 12736019.6.
International Search Report and Written Opinion for PCT/US2012/045481 dated Feb. 6, 2013.
International Preliminary Report on Patentability for PCT/US2012/045481 dated Jan. 16, 2014.
Chinese Office Action dated Feb. 4, 2015 for Application No. 201280041041.4.
Chinese Office Action for Application No. CN 201280041041.4 dated Aug. 26, 2015.
Invitation to Pay Additional Fees dated May 31, 2013 for Application No. PCT/US2012/050916.
International Search Report and Written Opinion dated Nov. 6, 2013 for Application No. PCT/US2012/050916.
International Preliminary Report on Patentability dated Mar. 13, 2014 for Application No. PCT/US2012/050916.
International Search Report and Written Opinion dated Sep. 25, 2015 for Application No. PCT/US2015/025921.
International Preliminary Report on Patentability dated Oct. 27, 2016 for Application No. PCT/US2015/025921.
International Search Report and Written Opinion dated Feb. 3, 2016 for Application No. PCT/US2015/061481.
Office Communication for U.S. Appl. No. 11/885,306 dated May 31, 2011.
Office Communication for U.S. Appl. No. 11/885,306 dated Oct. 20, 2011.
Office Communication for U.S. Appl. No. 11/885,306 dated May 8, 2012.
Office Communication dated Oct. 9, 2014 for U.S. Appl. No. 11/885,306.
Office Action dated Jul. 3, 2017 for U.S. Appl. No. 14/681,560.
Office Communication for U.S. Appl. No. 12/058,628 dated Feb. 25, 2009.
Office Communication for U.S. Appl. No. 12/058,628 dated Sep. 1, 2009.
Office Communication for U.S. Appl. No. 12/993,205 dated Jul. 11, 2012.
Office Communication for U.S. Appl. No. 12/993,205 dated Feb. 14, 2013.
Office Action for U.S. Appl. No. 13/967,018 dated Jun. 11, 2015.
Office Action for U.S. Appl. No. 13/967,018 dated Feb. 9, 2016.
Office Communication for U.S. Appl. No. 10/433,753 dated Sep. 22, 2006.
Office Communication for U.S. Appl. No. 10/433,753 dated Oct. 3, 2008.
Office Communication for U.S. Appl. No. 10/433,753 dated May 28, 2009.
Office Communication for U.S. Appl. No. 12/019,454 dated Dec. 24, 2009.
Office Action dated Nov. 20, 2014 for U.S. Appl. No. 13/390,584.
Office Communication for U.S. Appl. No. 13/049,957 dated Feb. 1, 2013.
Office Communication for U.S. Appl. No. 13/049,957 dated Sep. 17, 2013.
Office Communication for U.S. Appl. No. 13/049,957 dated Feb. 21, 2014.
Office Action for U.S. Appl. No. 13/049,957 dated Jan. 5, 2016.
Ex Parte Quayle Action for U.S. Appl. No. 13/477,636 dated Aug. 3, 2015.
Office Communication dated Apr. 1, 2016 for U.S. Appl. No. 14/961,460.
Office Action for U.S. Appl. No. 14/130,531 dated Oct. 20, 2015.
Office Communication for U.S. Appl. No. 13/586,628 dated Nov. 29, 2013.
Final Office Action dated Jun. 19, 2014 for U.S. Appl. No. 13/586,628.
Advisory Action dated Sep. 25, 2014 for U.S. Appl. No. 13/586,628.
Advisory Action dated Nov. 10, 2014 for U.S. Appl. No. 13/586,628.
Office Action for U.S. Appl. No. 13/586,628 dated Dec. 18, 2015.
[No Author Listed] ATP Determination Kit (A-22066). Molecular Probes. Product Information. 2003. 3 pages. Revised Apr. 23, 2003.
[No Author Listed] Hawley's Condensed Chemical Dictionary, (2007), 499, John Wiley & Sons, Inc. Online@ http://onlinelibrary.wiley.com/book/10.1002/9780470114735/titles headwords=Emulsion, (downloaded Jan. 9, 2016), pp. 1.
[No Author] "Parafin Wax". http://www.wikipedia.com [last accessed Feb. 15, 2014].
[No Author] "Wax". http://www.wikipedia.com [last accessed Feb. 15, 2014].
[No Author] Microfluidic ChipShop. Microfluidic product catalogue. Mar. 2005.
[No Author] Microfluidic ChipShop. Microfluidic product catalogue. Oct. 2009.
Abate et al. One-step formation of multiple emulsions in microfluidics. Lab on a Chip. Lab Chip. Jan. 21, 2011;11(2):253-8. Epub Oct. 22, 2010. DOI:10.1039/C0LC00236D. 6 pages.
Abate et al., High-order multiple emulsions formed in poly(dimethylsiloxane) microfluidics. Small. Sep. 2009;5(18):2030-2.
Adams et al., Entropically driven microphase transitions in mixtures of colloidal rods and spheres. Nature. May 28, 1998:393:349-52.
Adams et al., Smart Capsules: Engineering new temperature and pressure sensitive materials with microfluidics. MAR10 Meeting of the American Physical Society. Mar. 15-19, 2010. Portland, Oregon. Submitted Nov. 20, 2009. Last accessed Jun. 14, 2012 at http://absimage.aps.org/image/MAR10/MWS_MAR10-2009-007422.pdf. Abstract only. 1 page.
Ahn et al., Dielectrophoretic manipulation of drops for high-speed microfluidic sorting devices. Applied Physics Letters. 2006;88:024104. 3 pages. Month not cited on publication.
Ando et al., PLGA microspheres containing plasmid DNA: preservation of supercoiled DNA via cryopreparation and carbohydrate stabilization. J Pharm Sci. Jan. 1999;88(1):126-30.
Anna et al., Formation of dispersions using "flow focusing" in microchannels. Applied Physics Letters. Jan. 20, 2003;82(3):364-6.
Benichou et al., Double Emulsions Stabilized by New Molecular Recognition Hybrids of Natural Polymers. Polym Adv Tehcnol. 2002;13:1019-31. Month not cited on publication.
Bibette et al., Emulsions: basic principles. Rep Prog Phys. 1999;62:969-1033. Month not cited on publication.

(56) References Cited

OTHER PUBLICATIONS

Boone, et al. Plastic advances microfluidic devices. The devices debuted in silicon and glass, but plastic fabrication may make them hugely successful in biotechnology application. Analytical Chemistry. Feb. 2002; 78A-86A.
Chang et al. Controlled double emulsification utilizing 3D PDMS microchannels. Journal of Micromechanics and Microengineering. May 9, 2008;18:1-8.
Chao et al., Control of Concentration and Volume Gradients in Microfluidic Droplet Arrays for Protein Crystallization Screening. 26th Annual International Conference of the IEEE Engineering in Medicine and Biology Society. Francisco, California. Sep. 1-5, 2004. 4 pages.
Chao et al., Droplet Arrays in Microfluidic Channels for Combinatorial Screening Assays. Hilton Head 2004: A Solid State Sensor, Actuator and Microsystems Workshop. Hilton Head Island, South Carolina. Jun. 6-10, 2004:382-3.
Chen et al., Capturing a photoexcited molecular structure through time-domain x-ray absorption fine structure. Science. Apr. 13, 2001;292(5515):262-4.
Chen et al., Microfluidic Switch for Embryo and Cell Sorting. The 12th International Conference on Solid State Sensors, Actuators, and Microsystems. Boston, MA. Jun. 8-12, 2003. Transducers. 2003:659-62.
Cheng et al., Electro flow focusing in microfluidic devices. Microfluidics Poster, presented at DEAS, "Frontiers in Nanoscience," presented Apr. 10, 2003. 1 page.
Chiba et al., Controlled protein delivery from biodegradable tyrosine-containing poly(anhydride-co-imide) microspheres. Biomaterials. Jul. 1997;18(13):893-901.
Chou, et al. Disposable Microdevices for DNA Analysis and Cell Sorting. Proc. Solid-State Sensor and Actuator Workshop, Hilton Head, SC. Jun. 8-11, 1998; 11-14.
Chu et al., Controllable monodisperse multiple emulsions. Ang Chem Int Ed. 2007:46:8970-4. Published online Sep. 11, 2007.
Cohen et al., Controlled delivery systems for proteins based on poly(lactic/glycolic acid) microspheres. Pharm Res. Jun. 1991;8(6):713-20.
Cole, Gelatin. Encyclopedia of Food Science and Technology. Second Ed. Francis, ed. 2000:1183-8. http://www.gelatin.co.za/gltn1.html [last accessed Feb. 15, 2014].
Collins et al., Microfluidic flow transducer based on the measurement of electrical admittance. Lab Chip. Feb. 2004;4(1):7-10. Epub Nov. 11, 2003. (E-pub version).
Collins et al., Optimization of Shear Driven Droplet Generation in a Microfluidic Device. ASME International Mechanical Engineering Congress and R&D Expo. Washington, D.C. Nov. 15-21, 2003. 4 pages.
Cortesi et al., Production of lipospheres as carriers for bioactive compounds. Biomaterials. Jun. 2002;23(11):2283-94.
Dendukuri et al. Continuous-flow lithography for high-throughput microparticle synthesis. Nature Mat. May 2006;5:365-69.
Diaz et al., One-month sustained release microspheres of $^{125}$I-bovine calcitonin In vitro-in vivo studies. Journal of Controlled Release. 1999;59:55-62. Month not cited on publication.
Discher et al., Polymersomes: tough vesicles made from diblock copolymers. Science. May 14, 1999;284(5417):1143-6.
Dove et al., Research News. Nature Biotechnology. Dec. 2002;20:1213.
Dowding et al., Oil core-polymer shell microcapsules prepared by internal phase separation from emulsion droplets. I. Characterization and release rates for microcapsules with polystyrene shells. Langmuir. Dec. 21, 2004;20(26):11374-9.
Durant et al., Effects of cross-linking on the morphology of structured latex particles 1. Theoretical considerations. Macromol. 1996;29:8466-72. Month not cited on publication.
Edris et al., Encapsulation of orange oil in a spray dried double emulsion. Nahrung/Food. Apr. 2001;45(2):133-7.
Eow et al., Electrocoalesce-separators for the separation of aqueous drops from a flowing dielectric viscous liquid. Separation and Purification Technology. 2002;29:63-77.
Eow et al., Electrostatic and hydrodynamic separation of aqueous drops in a flowing viscous oil. Chemical Engineering and Processing. 2002;41:649-57.
Eow et al., Electrostatic enhancement of coalescence of water droplets in oil: a review of the technology. Chemical Engineering Journal. 2002;85:357-68.
Eow et al., Motion, deformation and break-up of aqueous drops in oils under high electric field strengths. Chemical Engineering and Processing. 2003;42:259-72.
Eow et al., The behaviour of a liquid-liquid interface and drop-interface coalescence under the influence of an electric field. Colloids and Surfaces A: Physiochem Eng Aspects. 2003;215:101-23.
Estes et al., Electroformation of giant liposomes from spin-coated films of lipids. Colloids Surf B Biointerfaces. May 10, 2005;42(2):115-23.
Fisher et al., Cell Encapsulation on a Microfluidic Platform. The Eighth International Conference on Miniaturised Systems for Chemistry and Life Sciences. MicroTAS. Malmo, Sweden. Sep. 26-30, 2004. 3 pages.
Fu et al., A microfabricated fluorescence-activated cell sorter. Nat Biotechnol. Nov. 1999;17(11):1109-11.
Fujiwara et al., Calcium carbonate microcapsules encapsulating biomacromolecules. Chemical Engineering Journal. Feb. 13, 2008;137(1):14-22.
Gallarate et al., On the stability of ascorbic acid in emulsified systems for topical and cosmetic use. Int J Pharm. Oct. 25, 1999;188(2):233-41.
Gañán-Calvo et al., Perfectly monodisperse microbubbling by capillary flow focusing. Phys Rev Lett. Dec. 31, 2001;87(27 Pt 1):274501. Epub Dec. 11, 2001. 4 pages.
Ganan-Calvo, Generation of Steady Liquid Microthreads and MicronSized Monodisperse Sprays in Gas Streams. Physical Review Letters. Jan. 12, 1998;80(2):285-8.
Ganan-Calvo, Perfectly monodisperse micro-bubble production by novel mechanical means. Scaling laws. American Physical Society 53rd Annual Meeting of the Division of Fluid Dynamics. Nov. 19-21, 2000. 1 page.
Gartner, et al. The Microfluidic Toolbox—examples for fluidic interfaces and standardization concepts. Proc. SPIE 4982, Microfluidics, BioMEMS, and Medical Microsystems, (Jan. 17, 2003); doi: 10.1117/12.479566.
Ghadessy et al. Directed evolution of polymerase function by compartmentalized self-replication. Proc Natl Acad Sci USA. Apr. 10, 2001; 98(8):4552-7. Epub Mar. 27, 2001.
Gordon et al., Self-assembled polymer membrane capsules inflated by osmotic pressure. JACS. 2004;126:14117-22. Published on web Oct. 12, 2004.
Graham et al., Nanogels and microgels: The new polymeric materials playground. Pure Appl Chem. 1998;70(6):1271-75. Month not cited on publication.
Grasland-Mongrain et al., Droplet coalescence in microfluidic devices. Jan.-Jul. 2003:1-30.
Griffiths et al., Man-made enzymes—from design to in vitro compartmentalisation. Curr Opin Biotechnol. Aug. 2000;11(4):338-53.
Griffiths et al., Miniaturising the Laboratory in Emulsion Droplets. Trends Biotechnol. Sep. 2006;24(9):395-402. Epub Jul. 14, 2006. (E-pub version).
Guery et al., Diffusion through colloidal shells under stress. Phys Rev E Stat Nonlin Soft Matter Phys. Jun. 2009;79(6 Pt 1):060402. Epub Jun. 29, 2009. 4 pages.
Hadd et al., Microchip device for performing enzyme assays. Anal Chem. Sep. 1, 1997;69(17):3407-12.
Hanes et al., Degradation of porous poly(anhydride-co-imide) microspheres and implications for controlled macromolecule delivery. Biomaterials. Jan.-Feb. 1998;19(1-3):163-72.
Hayward et al., Dewetting instability during the formation of polymersomes from block-copolymer-stabilized double emulsions. Langmuir. May 9, 2006;22(10):4457-61.
Holtze et al., Biocompatible surfactants for water-in-fluorocarbon emulsions. Lab Chip. Oct. 2008; 8(10):1632-9.

(56) References Cited

OTHER PUBLICATIONS

Hsu et al., Self-assembled shells composed of colloidal particles: fabrication and characterization. Langmuir. 2005;21:2963-70. Published on web Feb. 23, 2005.
Hug et al. Measurement of the number of molecules of a single mRNA species in a complex mRNA preparation. J Theor Biol. Apr. 21, 2003; 221(4):615-24.
Hung et al., Controlled Droplet Fusion in Microfluidic Devices. MicroTAS. Malmo, Sweden. Sep. 26-30, 2004. 3 pages.
Hung et al., Optimization of Droplet Generation by controlling PDMS Surface Hydrophobicity. 2004 ASME International Mechanical Engineering Congress and RD&D Expo. Anaheim, CA. Nov. 13-19, 2004. 2 pages.
Jang et al., Controllable delivery of non-viral DNA from porous scaffolds. J Control Release. Jan. 9, 2003;86(1):157-68.
Jo et al, Encapsulation of Bovine Serum Albumin in Temperature-Programmed "Shell-in-Shell" Structures. Macromol Rapid Commun. 2003;24:957-62. Month not cited on publication.
Jogun et al., Rheology and microstructure of dense suspensions of plate-shaped colloidal particles. J. Rheol. Jul./Aug. 1999;43:847-71.
Kanouni et al., Preparation of a stable double emulsion (W1/O/W2): role of the interfacial films on the stability of the system. Adv Colloid Interface Sci. Dec. 2, 2002;99(3):229-54.
Kawakatsu et al., Production of W/O/W emulsions and S/O/W pectin microcapsules by microchannel emulsification. Colloids and Surfaces. Jan. 2001;189:257-64.
Kim et al., Albumin loaded microsphere of amphiphilic poly(ethylene glycol)/poly(α-ester) multiblock copolymer. Eu. J. Pharm. Sci. 2004;23:245-51. Available online Sep. 27, 2004.
Kim et al., Colloidal assembly route for responsive colloidsomes with tunable permeability. Nano Lett. 2007;7:2876-80. Published on web Aug. 3, 2007.
Kim et al., Comparative study on sustained release of human growth hormone from semi-crystalline poly(L-lactic acid) and amorphous poly(D,L-lactic-co-glycolic acid) microspheres: morphological effect on protein release. J Control Release. Jul. 23, 2004;98(1):115-25.
Kim et al., Double-emulsion drops with ultra-thin shells for capsule templates. Lab Chip. Sep. 21, 2011;11(18):3162-6. Epub Aug. 2, 2011.
Kim et al., Fabrication of monodisperse gel shells and functional microgels in microfluidic devices. Angew Chem Int Ed. 2007;46:1819-22. Month not cited on publication.
Kim et al., Monodisperse nonspherical colloid materials with well-defined structures. Presentation. Sep. 16, 2005. 5 pages.
Kim et al., Synthesis of nonspherical colloidal particles with anisotropic properties. JACS. 2006;128:14374-77. Published on web Oct. 18, 2006.
Kim et al., Uniform nonspherical colloidal particles engineered by geometrically tunable gradient of crosslink density. 80th ACS Colloid Surf. Sci. Symp. Jun. 20, 2006. 23 pages.
Koo et al., A snowman-like array of colloidal dimers for antireflecting surfaces. Adv Mater. Feb. 3, 2004;16(3):274-77.
Kumar et al., Biodegradable block copolymers. Adv Drug Deliv Rev. Dec. 3, 2001;53(1):23-44.
Lamprecht et al., pH-sensitive microsphere delivery increases oral bioavailability of calcitonin. J Control Release. Jul. 23, 2004;98(1):1-9.
Landfester et al. Preparation of Polymer Particles in Nonaqueous Direct and Inverse Miniemulsions. Macromolecules. Mar. 11, 2000;33(7):2370-2376.
Landfester et al., Formulation and Stability Mechanisms of Polymerizable Miniemulsions. Macromolecules. 1999;32:5222-5228. Published on web Jul. 22, 1999.
Leary et al., Application of Advanced Cytometric and Molecular Technologies to Minimal Residual Disease Monitoring. In: In-Vitro Diagnostic Instrumentation. Gerald E. Cohn, Ed. Proceedings of SPIE. 2000;3913:36-44. Month not cited on publication.
Lee et al., Double emulsion-templated nanoparticle colloidosomes with selective permeability. Adv Mater. 2008;20:3498-503. Month not cited on publication.
Lee et al., Effective Formation of Silicone-in-Fluorocarbon-in-Water Double Emulsions: Studies on Droplet Morphology and Stability. Journal of Dispersion Science and Technology. 2002;23(4):491-7. Month not cited on publication.
Lee et al., Nonspherical colloidosomes with multiple compartments from double emulsions. Small. Sep. 2009;5(17):1932-5.
Lee et al., Preparation of Silica Particles Encapsulating Retinol Using O/W/O Multiple Emulsions. J Colloid Interface Sci. Aug. 1, 2001;240(1):83-89.
Lemoff et al., An AC Magnetohydrodynamic Microfluidic Switch for Micro Total Analysis Systems. Biomedical Microdevices. 2003;5(1):55-60. Month not cited on publication.
Li et al., PEGylated PLGA nanoparticles as protein carriers: synthesis, preparation and biodistribution in rats. Journal of Controlled Release. 2001;71:203-211. Month not cited on publication.
Lin et al., Ultrathin cross-linked nanoparticle membranes. JACS. 2003;125:12690-91. Published on web Sep. 27, 2003.
Link et al., Geometrically mediated breakup of drops in microfluidic devices. Phys Rev Lett. Feb. 6, 2004;92(5):054503. Epub Feb. 6, 2004. 4 pages.
Lopez-Herrera et al., Coaxial jets generated from electrified Taylor cones. Scaling laws. Aerosol Science. 2003:34:535-52. Month not cited on publication.
Lopez-Herrera et al., One-Dimensional Simulation of the Breakup of Capillary Jets of Conducting Liquids. Application to E.H.D. Spraying. J Aerosol Sci. 1999;30(7):895-912. Month not cited on publication.
Lopez-Herrera et al., The electrospraying of viscous and non-viscous semi-insulating liquids. Scalilng laws. Bulletin of the American Physical Society Nov. 1995;40:2041. Abstract JB 7.
Lorenceau et al., Generation of polymerosomes from double-emulsions. Langmuir. Sep. 27, 2005;21(20):9183-6.
Loscertales et al., Micro/nano encapsulation via electrified coaxial liquid jets. Science. Mar. 1, 2002;295(5560):1695-8.
Lundstrom et al., Breakthrough in cancer therapy: Encapsulation of drugs and viruses. www.currentdrugdiscovery.com. Nov. 2002:19-23.
Ly et al., Effect of Alcohols on Lipid Bilayer Rigidity, Stability, and Area/Molecule (in collaboration with David Block and Roland Faller). Available at http://www.chms.ucdavis.edu/research/web/longo/micromanipulation.html. Last accessed Oct. 10, 2012.
Magdassi et al., Formation of water/oil/water multiple emulsions with solid oil phase. J Coll Interface Sci. Dec. 1987;120(2):537-9.
Manoharan et al., Dense packing and symmetry in small clusters of microspheres. Science. Jul. 25, 2003;301:483-87.
Marques et al., Porous Flow within Concentric Cylinders. Bulletin of the American Physical Society Division of Fluid Dynamics. Nov. 1996;41:1768. Available at http://flux.aps.org/meetings/YR9596/BAPSDFD96/abs/G1070001.html (downloaded Oct. 11, 2006) 2 pages.
Mazutis et al., Selective droplet coalescence using microfluidic systems. Lab Chip. Apr. 24, 2012; 12(10):1800-6.
Melin et al., A liquid-triggered liquid microvalve for on-chip flow control. Sensors and Actuators B. May 2004;100(3):463-68.
Mock et al., Synthesis of anisotropic nanoparticles by seeded emulsion polymerization. Langmuir. Apr. 25, 2006;22(9):4037-43. Published on web Mar. 31, 2006.
Nagai et al., Solvent removal during curing process of highly spheric and monodispersed-sized polystyrene capsules from density-matched emulsions composed of water and benzene/1,2-dichloroethane. John Wiley & Sons, Inc. J Polym Sci A: Polym Chem. Aug. 3, 2000; 38: 3412-18.
Naka et al., Control of crystal nucleation and growth of calcium carbonate bysynthetic substrates. Chem Mater 2001;13:3245-59.
Nakano et al., Single-molecule PCR using water-in-oil emulsion. J Biotechnol. Apr. 24, 2003;102(2):117-24.
Nie et al., Polymer particles with various shapes and morphologies produced in continuous microfluidic reactors. J Am Chem Soc. Jun. 8, 2005;127(22):8058-63.
Nihant et al., Polylactide microparticles prepared by double emulsion/evaporation technique. I. Effect of primary emulsion stability. Pharm Res. Oct. 1994;11(10):1479-84.

(56) References Cited

OTHER PUBLICATIONS

Nikolaides et al., Two Dimensional Crystallisation on Curved Surfaces. MRS Fall 2000 Meeting. Boston, MA. Nov. 27, 2000. Abstract #41061.
Nisisako et al., Controlled formulation of monodisperse double emulsions in a multiple-phase microfluidic system. Soft Matter. 2005;1:23-7. Month not cited on publication.
Nisisako, Microstructured Devices for Preparing Controlled Multiple Emulsions. Chem Eng Technol. 2008;31:1091-8. Month not cited on publication.
Nof et al., Drug-releasing scaffolds fabricated from drug-loaded microspheres. J Biomed Mater Res. Feb. 2002;59(2):349-56.
Oh et al., Distribution of macropores in silica particles prepared by using multiple emulsions. J Colloid Interface Sci. Oct. 1, 2002;254(1):79-86.
Okubo et al., Micron-sized, monodisperse, snowman/confetti-shaped polymer particles by seeded dispersion polymerization. Colloid Polym. Sci. 2005;283:1041-45. Published online Apr. 2, 2005.
Okushima et al., Controlled production of monodisperse double emulsions by two-step droplet breakup in microfluidic devices. Langmuir. Nov. 9, 2004;20(23):9905-8.
Ouellette, A New Wave of Microfluidic Device. The Industrial Physicist. Aug./Sep. 2003:14-7.
Pannacci et al., Equilibrium and nonequilibrium states in microfluidic double emulsions. Phys Rev Lett. Oct. 17, 2008;101(16):164502. Epub Oct. 14, 2008. 4 pages.
Perez et al., Poly(lactic acid)-poly(ethylene glycol) nanoparticles as new carriers for the delivery of plasmid DNA. Journal of Controlled Release. 2001;75:211-224. Month not cited on publication.
Piemi et al., Transdermal delivery of glucose through hairless rat skin in vitro: effect of multiple and simple emulsions. Int J Pharm. 1998; 171:207-15. Month not cited on publication.
Priest et al., Generation of monodisperse gel emulsions in a microfluidic device. App Phys Lett. 2006;88:024106. 3 pages. Published online Jan. 12, 2006.
Raghuraman et al., Emulsion liquid membranes for wastewater treatment: equilibrium models for some typical metal-extractant systems. Environ Sci Technol. Jun. 1, 1994;28(6):1090-8.
Reculusa et al., Synthesis of daisy-shaped and multipod-like silica/polystyrene nanocomposites. Nano Lett. 2004;4:1677-82. Published on web Jul. 14, 2004.
Roh et al., Biphasic janus particles with nanoscale anisotropy. Nature Med. Oct. 2005;4:759-63.
Rojas et al., Induction of instability in water-in-oil-in-water double emulsions by freeze-thaw cycling. Langmuir. Jun. 19, 2007;23(13):6911-7. Epub May 24, 2007.
Rojas et al., Temperature-induced protein release from water-in-oil-in-water double emulsions. Langmuir. Jul. 15, 2008;24(14):7154-60. Epub Jun. 11, 2008.
Schubert et al., Designer Capsules. Nat Med. Dec. 2002;8:1362.
Seo et al., Microfluidic consecutive flow-focusing droplet generators. Soft Matter. 2007;3:986-92. Published online May 29, 2007.
Sheu et al., Phase separation in polystyrene latex interpenetrating polymer networks. J. Poly. Sci. A. Poly. Chem. 1990;28:629-51. Month not cited on publication.
Shum et al., Abstract: P9.00001 : Microfluidic Fabrication of Bio-compatible Vesicles by Self-assembly in Double Emulsions. 2008 APS March Meeting. Mar. 10-14, 2008. New Orleans, LAa. Submitted Nov. 26, 2007. Presented Mar. 12, 2008. Abstract Only.
Shum et al., Double emulsion templated monodisperse phospholipid vesicles. Langmuir. Aug. 5, 2008;24(15):7651-3. Epub Jul. 10, 2008.
Shum et al., Microfluidic Fabrication of Bio-compatible Vesicles Using Double Emulsion Drops as Templates. APS March Meeting 2008. Presented Mar. 12, 2008. 16 pages.
Shum et al., Microfluidic fabrication of monodisperse biocompatible and biodegradable polymersomes with controlled permeability. J Am Chem Soc. Jul. 23, 2008;130(29):9543-9. Epub Jun. 25, 2008.
Shum et al., Template-Directed Assembly of Amphiphiles in Controlled Emulsions by Microfluidics. 82nd ACS Colloid & Surface Science Symposium. Jun. 15-18, 2008. Presented Jun. 16, 2008. Abstract Only.
Silva-Cunha et al., W/O/W multiple emulsions of insulin containing a protease inhibitor and an absorption enhancer: biological activity after oral administration to normal and diabetic rats. Int J Pharmaceutics. 1998;169:33-44. Month not cited on publication.
Sim et al. The shape of a step structure as a design aspect to control droplet generation in microfluidics. J Micromech Microeng. Feb. 9, 2010;20:035010. 6 pages.
Skjeltorp et al., Preparation of nonspherical, monodisperse polymer particles and their self-organization. J. Colloid Interf. Sci. Oct. 1986;113:577-82.
Sohn et al., Capacitance cytometry: measuring biological cells one by one. Proc Natl Acad Sci U S A. Sep. 26, 2000;97(20):10687-90.
Song et al., A microfluidic system for controlling reaction networks in time. Angew Chem Int Ed Engl. Feb. 17, 2003;42(7):768-72.
Sun et al., Microfluidic melt emulsification for encapsulation and release of actives. ACS Appl Mater Interfaces. Dec. 2010;2(12):3411-6. Epub Nov. 17, 2010.
Takeuchi et al., An Axisymmetric Flow-Focusing Microfluidic Device. Adv Mater. Apr. 18, 2005;17:1067-72.
Tan et al., Controlled Fission of Droplet Emulsions in Bifurcating Microfluidic Channel. Boston. Transducers. 2003. 4 pages. Month not cited on publication.
Tan et al., Design of microfluidic channel geometries for the control of droplet volume, chemical concentration, and sorting. Lab Chip. Aug. 2004;4(4):292-8. Epub Jul. 1, 2004.
Tan, Monodisperse Droplet Emulsions in Co-Flow Microfluidic Channels. Lake Tahoe. Micro TAS. 2003. 2 pages.
Tawfik et al., Man-made cell-like compartments for molecular evolution. Nat Biotechnol. Jul. 1998;16(7):652-6.
Terray et al., Fabrication of linear colloidal structures for microfluidic applications. App Phys Lett. Aug. 26, 2002;81:1555-7.
Terray et al., Microfluidic control using colloidal devices. Science. Jun. 7, 2002;296(5574):1841-4.
Thomas et al., Using a liquid emulsion membrane system for the encapsulation of organic and inorganic substrates within inorganic microcapsules. Chem Commun (Camb). May 21, 2002;(10):1072-3.
Thorsen et al., Dynamic pattern formation in a vesicle-generating microfluidic device. Phys Rev Lett. Apr. 30, 2001;86(18):4163-6.
Ulrich, Chapter 1. General Introduction. Chem. Tech. Carbodiimides. 2007:1-7. Month not cited on publication.
Umbanhowar et al., Monodisperse Emulsion Generation via Drop Break Off in a Coflowing Stream. Langmuir. 2000;16:347-51. Published on web Oct. 14, 1999.
Utada et al., Monodisperse double emulsions generated from a microcapillary device. Science. Apr. 22, 2005;308(5721):537-41.
Van Blaaderen, Colloidal molecules and beyond. Science. Jul. 25, 2003;301:470-71.
Van Blaaderen, Colloids get complex. Nature. Feb. 2006;439:545-46.
Velev et al., Assembly of latex particles by using emulsion droplets. 3. Reverse (water in oil) system. Langmuir. 1997;13:1856-59. Month not cited on publication.
Velev et al., Assembly of latex particles using emulsion droplets as templates. 1. Microstructured hollow spheres. Langmuir. 1996;12:2374-84. Month not cited on publication.
Velev et al., Assembly of latex particles using emulsion droplets as templates. 2. Ball-like and composite aggregates. Langmuir. 1996;12:2385-91. Month not cited on publication.
Wang, Fabrication of a Toroidal Structure of Polymer Particle by Phase Separation with One Dimensional Axial Flow in Microchannel. . 82nd ACS Colloid & Surface Science Symposium. Jun. 15-18, 2008. Presented Jun. 17, 2008. Abstract Only.
Weitz, Nonspherical engineering of polymer colloids. Web Page. Exp. Soft Condensed Matter Group. Last updated Nov. 10, 2005. 1 page.
Weitz, Packing in the spheres. Science. Feb. 13, 2004;303:968-969.
Wolff et al., Integrating advanced functionality in a microfabricated high-throughput fluorescent-activated cell sorter. Lab Chip. Feb. 2003;3(1):22-7. Epub Jan. 23, 2003.

(56) References Cited

OTHER PUBLICATIONS

Xu et al., Generation of Monodisperse Particles by Using Microfluidics: Control over Size, Shape and Composition. Angew Chem Int Ed. 2004;43:2-5. Month not cited on publication.
Yamaguchi et al., Insulin-loaded biodegradable PLGA microcapsules: initial burst release controlled by hydrophilic additives. J Control Release. Jun. 17, 2002;81(3):235-49.
Yin et al., Template-assisted self-assembly: a practical route to complex aggregates of monodispersed colloids with well-defined sizes, shapes, and structures. JACS. 2001;123:8718-29. Published on web Aug. 15, 2001.
Yoon et al., Abstract: X8.00007 : Fabrication of phospholipid vesicles from double emulsions in microfluidics. 2008 APS March Meeting. Mar. 10-14, 2008. New Orleans, LA. Submitted Nov. 26, 2007. Presented Mar. 14, 2008. Abstract Only.
Yoon et al., Fabrication of giant phospholipid vesicles from double emulsions in microfluidics. APS March Meeting 2008. Presented Mar. 14, 2008. 11 pages.
Zhang et al., A Simple Statistical Parameter for Use in Evaluation and Validation of High Throughput Screening Assays. J Biomol Screen. 1999;4(2):67-73. Month not cited on publication.
Zhao et al., Enhanced encapsulation of actives in self-sealing microcapsules by precipitation in capsule shells. Langmuir. Dec. 6, 2011;27(23):13988-91. Epub Oct. 26, 2011.
Zhao, Preparation of hemoglobin-loaded nano-sized particles with porous structure as oxygen carriers. Biomaterials. 2007;28:1414-1422. Available online Nov. 28, 2006.
Zheng et al., A microfluidic approach for screening submicroliter volumes against multiple reagents by using preformed arrays of nanoliter plugs in a three-phase liquid/liquid/gas flow. Angew Chem Int Ed Engl. Apr. 22, 2005;44(17):2520-3.
Zimmermann et al., Microscale production of hybridomas by hypo-osmolar electrofusion. Hum Antibodies Hybridomas. Jan. 1992;3(1):14-8.
Brazilian Office Action dated Nov. 19, 2018 for Application No. BR112012004719-1.
Brazilian Office Action dated Jul. 16, 2019 for Application No. BR112013029729-8.
Office Action dated Feb. 8, 2018 for U.S. Appl. No. 14/681,560.
Office Action for U.S. Appl. No. 13/388,596 dated Nov. 23, 2015.
Office Action dated Jun. 16, 2016 for U.S. Appl. No. 13/388,596.
Office Action for U.S. Appl. No. 13/388,596 dated Apr. 21, 2017.
[No Author Listed] Experimental Soft Condensed Matter Group. Cool Picture of the Moment. Available at http://www.seas.harvard.edu/projects /weitzlab/coolpic16012007.html dated Jan. 16, 2007.
[No Author Listed], Toxnet, Toxicology Data Network. Vinyl Toluene. National Library of Medicine. 2015:1-38.
Dinsmore et al., Colloidosomes: selectively permeable capsules composed of colloidal particles. Science. Nov. 1, 2002;298(5595):1006-9.
Fulwyler et al., Production of uniform microspheres. Rev Sci Instr. Feb. 1973;44(2):204-6.
Gunther et al., Multiphase microfluidics: from flow characteristics to chemical and materials synthesis. Lab Chip. Sep. 27, 2006;6:1487-1503.
Kim et al., Uniform nonspherical colloidal particles with tunable shapes. Adv. Mater. 2007;19:2005-09. Month not cited on publication.
Norimatsu et al. Recent research on target fabrication for up-coming projects. Fusion Engineering and Design.1999. 44:449-459.
Oh et al., Hydrodynamic micro-encapsulation of aqueous fluids and cells via 'on the fly' photopolymerization. J Micromech and Microeng. Jan. 9, 2006;16(2);285-91.
Quevedo et al., Interfacial polymerization within a simplified microfluidic device: capturing capsules. J Am Chem Soc. Aug. 3, 2005;127(30):10498-9.
Tan et al., Microfluidic Liposome Generation from Monodisperse Droplet Emulsion-Towards the Realization of Artificial Cells. Summer Bioengineering Conference Jun. 25-9, 2003. Key Biscayne, Florida. 2 pages.
European Office Action for Application No. EP 10814401.5 dated Feb. 26, 2020.
Leng et al., Microfluidic crystallization. Lab Chip. 2009;9(1):24-34.
Indian Hearing Notice dated Jul. 30, 2020 for Application No. 1874/DELNP/2012.
Office Action dated Feb. 24, 2015 for U.S. Appl. No. 13/397,018.
Advisory Action dated Oct. 14, 2016 for U.S. Appl. No. 13/388,596.

* cited by examiner

MULTIPLE EMULSIONS CREATED USING JETTING AND OTHER TECHNIQUES

RELATED APPLICATIONS

This application is a continuation of Ser. No. 13/388,596, with a § 371 date of Apr. 16, 2012, entitled "Multiple Emulsions Created Using Jetting and Other Techniques," by Weitz, et al., which is a national stage filing of International Patent Application Serial No. PCT/US2010/047467, filed Sep. 1, 2010, entitled "Multiple Emulsions Created Using Jetting and Other Techniques," by Weitz, et al., which claims the benefit of U.S. Provisional Patent Application Ser. No. 61/239,405, filed Sep. 2, 2009, entitled "Multiple Emulsions Created Using Jetting and Other Techniques," by Weitz, et al.; and U.S. Provisional Patent Application Ser. No. 61/353,093, filed Jun. 9, 2010, entitled "Multiple Emulsions Created Using Jetting and Other Techniques," by Weitz, et al. Each of these is incorporated herein by reference.

GOVERNMENT FUNDING

Research leading to various aspects of the present invention were sponsored, at least in part, by the National Science Foundation, Grant Nos. DMR-0820484, DMR-0602684, DBI-0649865, and DMR-0213805. The U.S. Government has certain rights in the invention.

FIELD OF INVENTION

The present invention generally relates to emulsions, and more particularly, to multiple emulsions.

BACKGROUND

An emulsion is a fluidic state which exists when a first fluid is dispersed in a second fluid that is typically immiscible with the first fluid. Examples of common emulsions are oil in water and water in oil emulsions. Multiple emulsions are emulsions that are formed with more than two fluids, or two or more fluids arranged in a more complex manner than a typical two-fluid emulsion. For example, a multiple emulsion may be oil-in-water-in-oil ("o/w/o"), or water-in-oil-in-water ("w/o/w"). Multiple emulsions are of particular interest because of current and potential applications in fields such as pharmaceutical delivery, paints, inks and coatings, food and beverage, chemical separations, and health and beauty aids.

Typically, multiple emulsions of a droplet inside another droplet are made using a two-stage emulsification technique, such as by applying shear forces or emulsification through mixing to reduce the size of droplets formed during the emulsification process. Other methods such as membrane emulsification techniques using, for example, a porous glass membrane, have also been used to produce water-in-oil-in-water emulsions. Microfluidic techniques have also been used to produce droplets inside of droplets using a procedure including two or more steps. For example, see International Patent Application No. PCT/US2004/010903, filed Apr. 9, 2004, entitled "Formation and Control of Fluidic Species," by Link, et al., published as WO 2004/091763 on Oct. 28, 2004; or International Patent Application No. PCT/US03/20542, filed Jun. 30, 2003, entitled "Method and Apparatus for Fluid Dispersion," by Stone, et al., published as WO 2004/002627 on Jan. 8, 2004, each of which is incorporated herein by reference.

SUMMARY OF THE INVENTION

The present invention generally relates to emulsions, and more particularly, to multiple emulsions. The subject matter of the present invention involves, in some cases, interrelated products, alternative solutions to a particular problem, and/or a plurality of different uses of one or more systems and/or articles.

In one aspect, the invention is directed to an apparatus. In one set of embodiments, the apparatus includes a main microfluidic channel, at least one first side microfluidic channel intersecting the main microfluidic channel at a first intersection, and at least one second side microfluidic channel intersecting the main microfluidic channel at a second intersection distinct from the first intersection. In some cases, the second intersection separates the main microfluidic channel into a first portion on a first side and a second portion on an opposing side of the second intersection, where the first portion is defined on the side of the main microfluidic channel between the first intersection and the second intersection. In certain embodiments, the second portion of the main microfluidic channel has an average cross-sectional dimension between about 5% and about 20% larger than an average cross-sectional dimension of the first portion of the main microfluidic channel, relative to the average cross-sectional dimension of the first portion of the main microfluidic channel. In some instances, the first portion of the main microfluidic channel has a first hydrophilicity and the second portion of the main microfluidic channel has a second hydrophilicity different than the first hydrophilicity.

The invention, in another aspect, is directed to a method. In one set of embodiments, the method includes acts of providing a first fluid in a main microfluidic channel, flowing the first fluid to a first intersection of the main microfluidic channel and at least one first side microfluidic channel containing a second fluid to cause the first fluid to become surrounded by the second fluid without causing the first fluid to form separate droplets, flowing the first and second fluids to a second intersection of the main microfluidic channel and at least one second side microfluidic channel containing a third fluid to cause the second fluid to become surrounded by the third fluid without causing the first and second fluids to form separate droplets, and causing the first and second fluids to form individual droplets wherein the first fluid is contained within the second fluid and the second fluid is contained within the third fluid.

In one set of embodiments, the method includes acts of creating a multiple emulsion droplet in a carrying fluid within a quasi-two dimensional microfluidic channel. The multiple emulsion may include at least a carrying fluid and a first fluid surrounded by and in physical contact with the carrying fluid. In some (but not all) embodiments, an average distance of separation between a first interface between the carrying fluid and the first fluid, and a second interface between the first fluid and a second fluid, is no more than about 1 micrometer. In certain cases, an average distance of separation between a first interface between the carrying fluid and the first fluid, and a second interface between the first fluid and the second fluid, is no more than about 10% of the average dimension of the droplet. As discussed below, in some cases, the multiple emulsion may also contain other fluids or nestings of fluids, other species, etc.

In another aspect, the present invention is directed to an article including a first fluidic droplet surrounded by a second fluidic droplet, the second fluidic droplet surrounded by a third fluid. In one set of embodiments, the first fluidic droplet comprises a fluid that has a surface tension in air at 25° C. of no more than about 40 mN/m. In another set of embodiments, the first fluid has a first surface tension in air at 25° C. and the second fluid has a second surface tension in air 25° C., where the second surface tension is at least 2 times the first surface tension. In still another set of embodiments, the first fluid has a viscosity at 25° C. of at least 20 mPa s.

In yet another aspect, the article includes a second fluid comprising discrete droplets of a first fluid, at least about 90% of the discrete droplets of the first fluid having a distribution of diameters such that no more than about 10% of the discrete droplets have a dimension greater than about 10% of the average dimension of the discrete droplets. In one set of embodiments, the first fluidic droplet comprises a fluid that has a surface tension in air at 25° C. of no more than about 40 mN/m. In another set of embodiments, the first fluid has a first surface tension in air at 25° C. and the second fluid has a second surface tension in air 25° C., where the second surface tension is at least 2 times the first surface tension. In still another set of embodiments, the first fluid has a viscosity at 25° C. of at least 20 mPa s.

Still another aspect of the invention is directed to a method of making a multiple emulsion, including an act of forming a first droplet from a first fluid surrounded by a second fluid while the second fluid is surrounded by a third fluid. In one set of embodiments, the first fluidic droplet comprises a fluid that has a surface tension in air at 25° C. of no more than about 40 mN/m. In another set of embodiments, the first fluid has a first surface tension in air at 25° C. and the second fluid has a second surface tension in air 25° C., where the second surface tension is at least 2 times the first surface tension. In still another set of embodiments, the first fluid has a viscosity at 25° C. of at least 20 mPa s.

In another aspect, the present invention is directed to a method of making one or more of the embodiments described herein, for example, a multiple emulsion. In another aspect, the present invention is directed to a method of using one or more of the embodiments described herein, for example, a multiple emulsion.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1A:
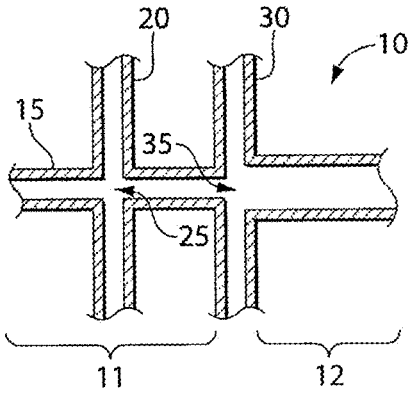
FIGS. 1A-1B illustrate various non-limiting fluidic channels, useful for producing droplets in accordance with certain embodiments of the invention.

The present invention generally relates to emulsions, and more particularly, to multiple emulsions. In one aspect, multiple emulsions are formed by urging a fluid into a channel, e.g., by causing the fluid to enter the channel as a "jet." Side channels can be used to encapsulate the fluid with a surrounding fluid. In some cases, multiple fluids may flow through a channel collinearly before multiple emulsion droplets are formed. The fluidic channels may also, in certain embodiments, include varying degrees of hydrophilicity or hydrophobicity. As examples, the fluidic channel may be relatively hydrophilic upstream of an intersection (or other region within the channel) and relatively hydrophobic downstream of the intersection, or vice versa. In some cases, the average cross-sectional dimension may change, e.g., at an intersection. For instance, the average cross-sectional dimension may increase at the intersection. Surprisingly, a relatively small increase in dimension, in combination with a change in hydrophilicity of the fluidic channel, may delay droplet formation of a stream of collinearly-flowing multiple fluids under certain flow conditions; accordingly, the point at which multiple emulsion droplets are formed can be readily controlled within the fluidic channel. In some cases, the multiple droplet may be formed from the collinear flow of fluids at (or near) a single location within the fluidic channel. In addition, unexpectedly, systems such as those described herein may be used to encapsulate fluids in single or multiple emulsions that are difficult or impossible to encapsulate using other techniques, such as fluids with low surface tension, viscous fluids, or viscoelastic fluids. Other aspects of the invention are generally directed to methods of making and using such systems, kits involving such systems, emulsions created using such systems, or the like.

Thus, in certain embodiments, the present invention generally relates to emulsions, including multiple emulsions, and to methods and apparatuses for making such emulsions. A "multiple emulsion," as used herein, describes larger droplets that contain one or more smaller droplets therein. In a double emulsion, the larger droplets may, in turn, be contained within another fluid, which may be the same or different than the fluid within the smaller droplet. In certain embodiments, larger degrees of nesting within the multiple emulsion are possible. For example, an emulsion may contain droplets containing smaller droplets therein, where at least some of the smaller droplets contain even smaller droplets therein, etc. Multiple emulsions can be useful for encapsulating species such as pharmaceutical agents, cells, chemicals, or the like. As described below, multiple emulsions can be formed in certain embodiments with generally precise repeatability. In some cases, the encapsulation of the agent may be performed relatively quantitatively, as discussed below.

Fields in which emulsions or multiple emulsions may prove useful include, for example, food, beverage, health and beauty aids, paints and coatings, and drugs and drug delivery. For instance, a precise quantity of a drug, pharmaceutical, or other agent can be contained within an emulsion, or in some instances, cells can be contained within a droplet, and the cells can be stored and/or delivered. Other species that can be stored and/or delivered include, for example, biochemical species such as nucleic acids such as siRNA, RNAi and DNA, proteins, peptides, or enzymes, or the like. Additional species that can be incorporated within an emulsion of the invention include, but are not limited to, nanoparticles, quantum dots, fragrances, proteins, indicators, dyes, fluorescent species, chemicals, drugs, or the like. An emulsion can also serve as a reaction vessel in certain cases, such as for controlling chemical reactions, or for in vitro transcription and translation, e.g., for directed evolution technology.

Using the methods and devices described herein, in some embodiments, an emulsion having a consistent size and/or number of droplets can be produced, and/or a consistent ratio of size and/or number of outer droplets to inner droplets (or other such ratios) can be produced for cases involving multiple emulsions. For example, in some cases, a single droplet within an outer droplet of predictable size can be used to provide a specific quantity of a drug. In addition, combinations of compounds or drugs may be stored, transported, or delivered in a droplet. For instance, hydrophobic and hydrophilic species can be delivered in a single, multiple emulsion droplet, as the droplet can include both hydrophilic and hydrophobic portions. The amount and concentration of each of these portions can be consistently controlled according to certain embodiments of the invention, which can provide for a predictable and consistent ratio of two or more species in a multiple emulsion droplet.

The following documents are each incorporated herein by reference: International Patent Application Serial No. PCT/US2008/004097, filed Mar. 28, 2008, entitled "Emulsions and Techniques for Formation," by Chu, et al., published as WO 2008/121342 on Oct. 9, 2008; International Patent Application No. PCT/US2006/007772, filed Mar. 3, 2006, entitled "Method and Apparatus for Forming Multiple Emulsions," by Weitz, et al., published as WO 2006/096571 on Sep. 14, 2006; and U.S. Provisional Patent Application Ser. No. 61/160,020, filed Mar. 13, 2009, entitled "Controlled Creation of Emulsions, Including Multiple Emulsions," by Weitz, et al. Also incorporated herein by reference are U.S. Provisional Patent Application Ser. No. 61/239,402, filed on Sep. 22, 2009, entitled "Multiple Emulsions Created Using Junctions," by Weitz, et al.; and U.S. Provisional Patent Application Ser. No. 61/239,405, filed on Sep. 22, 2009, entitled "Multiple Emulsions Created Using Jetting and Other Techniques," by Weitz, et al. In one aspect, the present invention is generally directed to methods of creating multiple emulsions, including double emulsions, triple emulsions, and other higher-order emulsions. In one set of embodiments, a fluid flows through a channel, and is surrounded by another fluid. In some cases, the two fluids may flow in a collinear fashion, e.g., without creating individual droplets. The two fluids may then be surrounded by yet another fluid, which may flow collinearly with the first two fluids in some embodiments, and/or cause the fluids to form discrete droplets within the channel. In some cases, streams of multiple collinear fluids may be formed, and/or caused to form triple or higher-order emulsions. In some cases, as discussed below, this may occur as a single process, e.g., the multiple emulsion is formed at substantially the same time from the various streams of collinear fluids.

Referring now to FIG. 1A, a non-limiting example of this process is discussed. In this figure, system 10 includes a main channel 15, which can be a microfluidic channel. Intersecting main channel 15 are a plurality of side channels. Main channel 15 in FIG. 1A is shown as being substantially straight; however, in other embodiments, the main channel may be curved, angled, bent, or have other shapes.

In addition, in FIG. 1A, two sets of channels are shown intersecting main channel 15: a first set of channels 20 that intersects main channel 15 to define intersection 25, and a second set of channels 30 that intersects main channel 15 to define intersection 35. In other embodiments, however, there may be different numbers of side channels, and/or different numbers of intersections. For example, larger numbers of intersections may be used to create higher-order multiple emulsions (e.g., having first, second, and third intersections to create triple emulsions, four intersections to create quadruple emulsions, etc.), and/or different numbers of side channels may intersect the main channel. For example, an intersection may be defined by one side channel, 3 side channels, 4 side channels, 5 side channels, etc. Other examples of such systems are disclosed in U.S. Provisional Patent Application Ser. No. 61/239,402, filed on Sep. 22, 2009, entitled "Multiple Emulsions Created Using Junctions," by Weitz, et al.; and U.S. Provisional Patent Application Ser. No. 61/239,405, filed on Sep. 22, 2009, entitled "Multiple Emulsions Created Using Jetting and Other Techniques," by Weitz, et al.; each incorporated herein by reference.

In FIG. 1A, each side channel intersects the main channel at substantially right angles; however, in other embodiments, the side channels need not intersect the main channel at substantially right angles. In addition, in certain cases, the number of side channels need not be the same between different intersections. For instance, a first intersection may be defined by two side channels intersecting the main channel, while a second intersection may be defined by 1 or 3 side channels intersecting the main channel, etc.

In one set of embodiment, the main channel may contain a first portion and a second portion distinct from the first portion. The first portion and second portion can each be defined as being on different sides of one of the intersections of the main channel with one of the side channels, or the first portion and the second portions may be defined at separate points within the main channel (i.e., not necessarily defined by an intersection). For example, referring again to FIG. 1A, first channel 15 includes a first portion 11 and a second portion 12, defined on different sides of the main channel around intersection 35. One or more portions may contain other intersections therein, e.g., intersection 25 for first portion 11 in FIG. 1A.

According to one set of embodiments, the first portion and the second portion may have different average cross-sectional dimension, where the "average cross-sectional dimension" is defined perpendicular to fluid flow within the channel. The average cross-sectional dimensions of each portion may be determined in a region immediately adjacent to the intersection defining the first and second portions of the main channel. In some cases, the average cross-sectional dimension of a microfluidic channel may be the diameter of a perfect circle having an area equal to the area of the cross-section of the microfluidic channel.

In certain embodiments, the first portion may be smaller than the second portion. For example, the second portion may have an average cross-sectional dimension that is at least about 5% larger than an average cross-sectional dimension of the first portion of the main fluidic channel, and in some cases, at least about 10%, at least about 15%, at least about 20%, at least about 25%, etc. The percentages can be determined relative to the average cross-sectional dimension of the first portion of the main fluidic channel. In certain cases, the second portion has an average cross-sectional dimension that is between about 5% and about 20%, between about 10% and about 20%, or between about 5% and about 10% larger than an average cross-sectional dimension of the first portion of the main fluidic channel. In other cases, however, the first portion is smaller than the second portion, e.g., at least about 5% smaller than an average cross-sectional dimension of the first portion of the main fluidic channel, and in some cases, at least about 10%, at least about 15%, at least about 20%, at least about 25%, etc., or the second portion may have an average cross-sectional dimension that is between about 5% and about 20%, between about 10% and about 20%, or between about 5% and about 10% smaller than an average cross-sectional dimension of the first portion of the main fluidic channel. It should be noted that the difference in cross-sectional dimension of the first portion and the second portion may be a difference in one dimension (e.g., the portions may have the same height and different widths or vice versa) or in some cases, the difference may be in two dimensions (e.g., the portions differ in both height and width).

Without wishing to be bound by any theory, in certain cases, using a larger second portion, relative to the first portion, may facilitate the collinear flow of multiple streams of fluid in the main channel without causing one of the fluids to break up to create individual droplets. It is believed that this can occur as the increase in average cross-sectional dimension may facilitate increased flow of fluid and/or prevent the inner fluids from contacting the sides of the fluidic channel. For example, fluid entering the channel may be directed at a first speed such that the fluid does not break into individual droplets (e.g., under "jetting" behavior), then the fluid may be slowed down, for instance, by increasing the average cross-sectional dimension of the channel such that the fluid is able to break into individual droplets. In some cases, such fluid behavior can be determined using "Weber numbers" (We), where the Weber number can be thought of as the balance or ratio between inertial effects (which keeps the fluid coherent) and surface tension effects (which causes the fluid to tend to form droplets). The Weber number is often expressed as a dimensionless ratio of surface tension effects divided by inertial effects, i.e., when the Weber number is greater than 1, surface tension effects dominate, and when the Weber number is less than 1, inertial effects dominate. Thus, under certain conditions, fluid within a channel can be prevented from forming droplets if the fluid flows under conditions such that fluid inertial forces are able to dominate surface tension effects. For instance, by controlling the Weber number of the fluids within the channel, the point at which the fluid within the channel breaks into individual droplets can be controlled, i.e., by controlling the point at which surface tension effects begin to dominate over inertial effects. The Weber number can be controlled, for instance, by controlling the speed of fluid within the channel and/or the shape or size of the channel, e.g., its average cross-sectional dimension. Thus, for example, knowing the composition of the entering fluid (and thus, its density and surface tension) and the desired volumetric flow rate (e.g., by knowing the relative pressure change through the main channel), the average cross-sectional dimension of the channel can be controlled such that a first portion of the channel exhibits a Weber number of less than 1 while a second portion of the channel exhibits a Weber number greater than 1. The fluid may be drawn through the channel using any suitable technique, e.g., using positive or negative (vacuum) pressures (i.e., pressures less than atmospheric or ambient pressure). A specific non-limiting example of control of fluid within the channel is discussed in Example 1.

In some (but not all) embodiments, the hydrophilicities of the first and second portions may be different. In other embodiments, however, the hydrophilicities of the first and second portions may be the same. Hydrophilicities may be determined, for example, using water contact angle measurements or the like. For instance, the first portion may have a first hydrophilicity and the second portion may have a second hydrophilicity substantially different than the first hydrophilicity, for example, being more hydrophilic or more hydrophobic. The hydrophilicities of the portions may be controlled, for example, as discussed below. Other suitable techniques for controlling hydrophilicity may be found in International Patent Application No. PCT/US2009/000850, filed Feb. 11, 2009, entitled "Surfaces, Including Microfluidic Channels, with Controlled Wetting Properties," by Abate, et al., published as WO 2009/120254 on Oct. 1, 2009; and International Patent Application No. PCT/US2008/009477, filed Aug. 7, 2008, entitled "Metal Oxide Coating on Surfaces," by Weitz, et al., published as WO 2009/020633 on Feb. 12, 2009, each of which is incorporated herein by reference. In some cases, different portions of a channel may have different hydrophilicities, e.g., as is discussed in U.S. Provisional Patent application Ser. No. 61,239,402, filed on Sep. 22, 2009, entitled "Multiple Emulsions Created Using Junctions," by Weitz, et al.; and U.S. Provisional Patent Application Ser. No. 61/239,405, filed on Sep. 22, 2009, entitled "Multiple Emulsions Created Using Jetting and Other Techniques," by Weitz, et al.; each incorporated herein by reference.

Not only is it unexpected that a relatively small increase in dimension, in combination with a change in hydrophilicity of the fluidic channel, may delay droplet formation of a stream of collinearly-flowing multiple fluids under certain flow conditions, it is also unexpected that such a systems allows the ability to create emulsions or multiple emulsions using fluids that are difficult or impossible to form into emulsions, e.g., due to the fluid having low surface tension, having high viscosity, or exhibiting viscoelastic properties.

In one set of embodiments, the "difficult" fluid may be used as an inner fluid, while a different fluid, such as water may be used as a surrounding or outer fluid. The outer fluid may be one that readily forms droplets or emulsifies, such as water, or other fluids as disclosed herein. While the inner fluid may not readily emulsify to form droplets in isolation, the action of the outer fluid in forming droplets, e.g., as discussed herein, also causes the inner fluid to form droplets, thereby producing a multiple emulsion in which a droplet of the inner fluid is surrounded by a droplet of the outer fluid, which in turn is contained within a carrying fluid. This process may be repeated, e.g., to create higher-level multiple emulsions, or the carrying fluid may be removed (e.g., by filtration) such that the outer fluid is able to condense into a continuous fluid, thereby forming a single emulsion of droplets of the inner fluid in a continuous outer fluid. As discussed herein, in some cases, the droplet formation process may also be controlled to produce monodisperse droplets of substantially the same shape and/or size. Accordingly, in various embodiments of the present invention, emulsions may be created that contain fluids that are difficult to emulsify under other conditions, such as fluids having low surface tension, having high viscosity, or exhibiting viscoelastic properties.

For example, without wishing to be bound by any theory, fluids having low surface tension do not readily emulsify, since such fluids do not readily dissociate into individual droplets, instead preferring to form continuous fluids or jets. The surface tension of a fluid can be thought of as a measure of the tendency of the fluid to prefer to bind to itself rather than to another fluid, so that fluids having high surface tension tend to form spherical shapes or individual droplets in order to minimize the exposed surface area per volume. In contrast, fluids having low surface tension do not typically exhibit this property (or exhibit it poorly), and are generally unsuitable for emulsification as a result.

Thus, it is surprising that, in certain embodiments of the invention, an emulsion or a multiple emulsion can be formed using a fluid having low surface tension. For example, the surface tension of the fluid (typically measured at 25° C. and 1 atm relative to air) may be no more than about 40 mN/m, no more than about 35 mN/m, no more than about 30 mN/m, no more than about 25 mN/m, no more than about 20 mN/m, or no more than about 15 mN/m. The surface tension of a fluid can be determined using any suitable technique known to those of ordinary skill in the art, for example, the Du Nouy Ring method, the Wilhelmy plate method, the spinning drop method, the pendant drop method, the bubble pressure method (or Jaeger's method), the drop volume method, the capillary rise method, the stalagmometric method, or the sessile drop method. Non-limiting examples of fluids having low surface tension include non-polar and/or organic fluids such as octanol, diethyl ether, hexane, isopropanol, octane, ethanol, methanol, acetone, acetic acid, or the like. In some cases, the surface tension may be measured relative to the surface tension of a surrounding fluid. For example, an inner fluid having low surface tension may be surrounded by an outer fluid having a surface tension that is at least about 2, at least about 2.5, at least about 3, at least about 4, at least about 5, at least about 7, at least about 10, etc. times greater than the surface tension of the inner fluid.

In another set of embodiments, the inner fluid may be one that has relatively high viscosity. High viscosity fluids are ones that do not flow quickly or readily, and hence do not quickly form droplets. For instance, the viscosity of the fluid may be at least about 15 mPa s, at least about 20 mPa s, at least about 30 mPa s, at least about 100 mPa s, at least about 300 mPa s, at least about 1,000 mPa s, at least about 3,000 mPa s, at least about $10^4$ mPa s, etc. Typically, the viscosity of a fluid is determined at 25° C., using techniques known to those of ordinary skill in the art, such as viscometers, e.g., U-tube viscometers, falling sphere viscometers, falling piston viscometers, oscillating piston viscometers, vibrational viscometers, rotational viscometers, bubble viscometers, etc. Examples of fluids having relatively high viscosities include, but are not limited to, corn syrup, glycerol, honey, polymeric solutions (e.g., polyurethane (PU)/polybutadiene (PBD) copolymer, polyethylene glycol, polypropylene glycol, etc.), or the like.

In some embodiments, a fluid having high viscosity also exhibits elastic properties more typical of a solid, i.e., the fluid is viscoelastic. Elasticity may be thought of as the tendency of a material to try to return to its original shape when subjected to an external stress (in contrast, a pure fluid has no tendency or ability to return to its original shape once stress is applied, independent of the container containing the fluid); such fluids typically cannot be emulsified because of this tendency, rather than forming droplets. Typically, elasticity is measured by determining Young's modulus, usually at 25° C. For example, a fluid may have a Young's modulus of at least about 0.01 GPa, at least about 0.03 GPa, at least about 0.1 GPa, at least about 0.3 GPa, at least about 1 GPa, at least about 3 GPa, or at least about 10 GPa. Young's modulus can be measured using any suitable technique known to those of ordinary skill in the art, for example, by determining the stress-strain relationship for such fluids.

In various embodiments, the droplets formed as discussed herein may be of substantially the same shape and/or size (i.e., "monodisperse"), or of different shapes and/or sizes, depending on the particular application. As used herein, the term "fluid" generally refers to a substance that tends to flow and to conform to the outline of its container, i.e., a liquid, a gas, a viscoelastic fluid, etc. Typically, fluids are materials that are unable to withstand a static shear stress, and when a shear stress is applied, the fluid experiences a continuing and permanent distortion. The fluid may have any suitable viscosity that permits flow. If two or more fluids are present, each fluid may be independently selected among essentially any fluids (liquids, gases, and the like) by those of ordinary skill in the art, by considering the relationship between the fluids. In some cases, the droplets may be contained within a carrier fluid, e.g., a liquid. It should be noted, however, that the present invention is not limited to only multiple emulsions. In some embodiments, single emulsions can also be produced.

A "droplet," as used herein, is an isolated portion of a first fluid that is surrounded by a second fluid. It is to be noted that a droplet is not necessarily spherical, but may assume other shapes as well, for example, depending on the external environment. In one embodiment, the droplet has a minimum cross-sectional dimension that is substantially equal to the largest dimension of the channel perpendicular to fluid flow in which the droplet is located. In some cases, the droplets will have a homogenous distribution of diameters, i.e., the droplets may have a distribution of diameters such that no more than about 10%, about 5%, about 3%, about 1%, about 0.03%, or about 0.01% of the droplets have an average diameter greater than about 10%, about 5%, about 3%, about 1%, about 0.03%, or about 0.01% of the average diameter of the droplets, and correspondingly, droplets within the outlet channel may have the same, or similar, distribution of diameters. Techniques for producing such a homogenous distribution of diameters are also disclosed in International Patent Application No. PCT/US2004/010903, filed Apr. 9, 2004, entitled "Formation and Control of Fluidic Species," by Link, et al., published as WO 2004/091763 on Oct. 28, 2004, incorporated herein by reference, and in other references as described herein.

In one set of embodiments, an inner fluid flows through the main channel, while an outer fluid flows into a first intersection through one or more side channels, and a carrying fluid flows into a second intersection through one or more side channels. In some cases, the outer fluid, upon entry into the main channel, may surround the inner fluid without causing the inner fluid to form separate droplets. For instance, the inner fluid and the outer fluid may flow collinearly within the main channel. The outer fluid, in some cases, may surround the inner fluid, preventing the inner fluid from contacting the walls of the fluidic channel; for instance, the channel may widen upon entry of the outer fluid in some embodiments. In some cases, additional channels may bring additional fluids to the main channel without causing droplet formation to occur. In certain instances, a carrying fluid may be introduced into the main channel, surrounding the inner and outer fluids. In some cases, introduction of the carrying fluid may cause the fluids to form into separate droplets (e.g., of an inner fluid, surrounded by an outer fluid, which is in turn surrounded by a carrying fluid); in other cases, however, droplet formation may be delayed, e.g., by controlling the Weber number of the carrying fluid, as previously discussed. The carrying fluid, in some embodiments, may prevent the inner and/or outer fluids from contacting the walls of fluidic channel; for instance, the channel may widen upon entry of the carrying fluid, or in some cases, carrying fluid may be added using more than one side channel and/or at more than one intersection.

In some cases, more than three fluids may be present. For example, there may be four, five, six, or more fluids flowing collinearly within a microfluidic channel, e.g., formed using techniques such as those described herein, and in some cases, repeatedly used, e.g., involving three, four, five, six, etc., or more intersections, multiple changes in hydrophilicity and/or average cross-sectional dimension, or the like. In some cases, some or all of these fluids may exhibit jetting behavior, e.g., the fluids may be allowed to jet without being broken into individual droplets. For instance, multiple collinear streams of fluid may be formed within a microfluidic channel, and in some cases, one or more of the streams of fluid may exhibit jetting behavior. Thus, one embodiment of the invention is generally directed to the formation of two, three, four, or more collinear fluids within a microfluidic channel, some or all of which exhibit jetting behavior. In some cases, as discussed below, some or all of these fluids may be hardened, e.g., to produce hardened streams or threads. In other embodiments, the collinearly flowing fluids may be caused to form a multiple emulsion droplet, as discussed herein. In some cases, the multiple emulsion droplet may be formed in a single step, e.g., without creating single or double emulsion droplets prior to creating the multiple emulsion droplet.

Figure 1B:
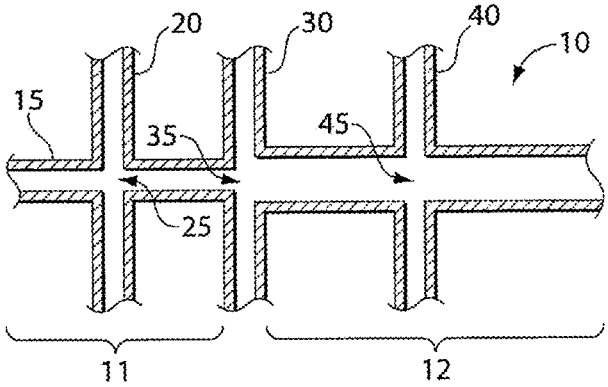

A non-limiting example of a system involving three separate intersections is shown in FIG. 1B. In this figure, system 10 includes a main channel 15, which can be a microfluidic channel, with intersections 25, 35, and 45, each formed by the intersection of various side channels (first channels 20, second channels 30, and third channels 40) with main channel 15. In this example, intersection 35 is used to define a first portion 11 of the main channel and a second portion 12, although in other embodiments, the first and second portions may be defined in other ways, e.g., at another intersection or location within the main channel. In this example, second portion 12 has an average cross-sectional dimension that is greater than the average cross-sectional dimension of the first portion. In some cases, the first portion and the second portion may also exhibit different hydrophilicities as well. For instance, first portion 11 may be relatively hydrophilic, while second portion 12 may be relatively hydrophobic, and the various hydrophilicities may be controlled, for example, using sol-gel coatings such as those discussed herein.

Figure 2:
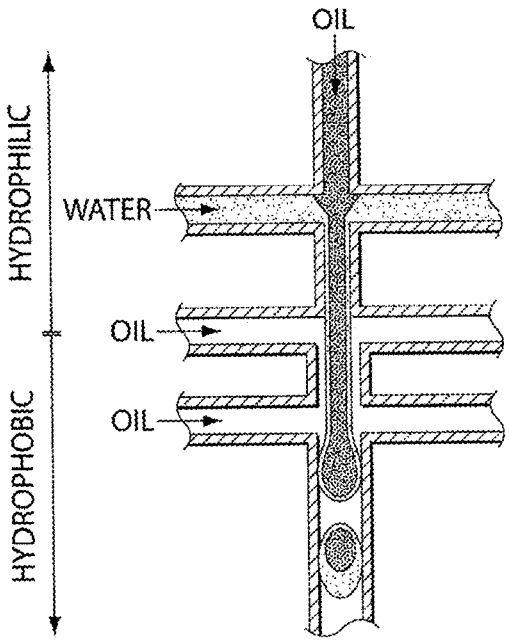
FIG. 2 illustrates a device able to produce multiple emulsions, according to another embodiment of the invention.
Figure 3:
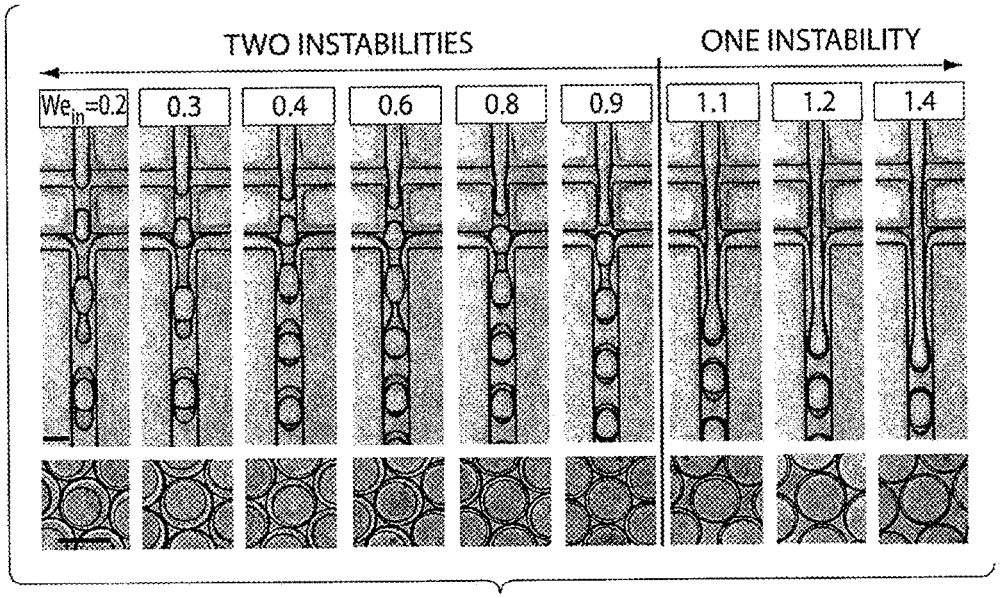
FIG. 3 shows various optical microscopy images of various double emulsions formed in a dual-junction device, in yet another embodiment of the invention.

According to one set of embodiments, an inner fluid may be delivered to system 10 through main channel 15, while an outer fluid can be delivered through side channels 20, meeting main channel 15 at intersection 25. The inner and outer fluids, in some embodiments, may flow collinearly without the formation of droplets in main channel 25 between intersections 25 and 35. At intersection 35, an outer fluid may be delivered via side channels 30. The carrying fluid may surround the inner and outer fluids, in some cases causing the inner and outer fluids to form multiple emulsion droplets (where the outer fluid surrounds the inner fluid), but in other cases, the various fluids may flow collinearly without the formation of droplets. For instance, in some cases, channels 40 may also contain carrying fluid, and the introduction of additional carrying fluid may cause the formation of separate droplets to occur. A non-limiting example of this process is illustrated in FIGS. 2 and 3 for an oil/water/oil multiple emulsion droplet.

In another set of embodiments, a system such as the example shown in FIG. 1B may be used to form quadruple emulsion droplets. For example, channel 15 may contain a first fluid, channel 20 a second fluid, channel 30 a third fluid, and channel 40 a carrying fluid to create a quadruple emulsion droplet of the first fluid, surrounded by the second fluid, surrounded by the third fluid, which is contained within the carrying fluid.

In certain aspects, double or multiple emulsions containing relatively thin layers of fluid may be formed, e.g., using techniques such as those discussed herein. In some instances, one or more fluids may be hardened. Similar techniques may be used to harden streams or jets of fluids (i.e., without necessarily forming droplets or emulsions). For example, collinear streams of fluid may be hardened to form threads, including nested threads comprising several nested layers, using fluid hardening techniques such as those described below.

In some cases, relatively thin layers of fluid may be formed by controlling the flow rates of the various fluids forming the multiple emulsion and/or controlling the Weber number such that the multiple emulsion droplet that is formed has a relatively large amount of one fluid (e.g., the innermost fluid), compared to other fluids. Surprisingly, by controlling the flow rates and the Weber numbers as discussed herein, very thin "shells" of fluid may be formed surrounding a droplet, unlike in other techniques in which the thickness of the fluid is inherently limited.

In one set of embodiments, a fluid "shell" surrounding a droplet may be defined as being between two interfaces, a first interface between a first fluid and a carrying fluid, and a second interface between the first fluid and a second fluid. The interfaces may have an average distance of separation (determined as an average over the droplet) that is no more than about 1 mm, about 300 micrometers, about 100 micrometers, about 30 micrometers, about 10 micrometers, about 3 micrometers, about 1 micrometers, etc. In some cases, the interfaces may have an average distance of separation defined relative to the average dimension of the droplet. For instance, the average distance of separation may be less than about 30%, less than about 25%, less than about 20%, less than about 15%, less than about 10%, less than about 5%, less than about 3%, less than about 2%, or less than about 1% of the average dimension of the droplet.

Examples of fluid hardening techniques useful for forming hardened droplets and/or hardened streams of fluid include those discussed in detail below, as well as those disclosed in International Patent Application No. PCT/US2004/010903, filed Apr. 9, 2004, entitled "Formation and Control of Fluidic Species," by Link, et al., published as WO 2004/091763 on Oct. 28, 2004; U.S. patent application Ser. No. 11/368,263, filed Mar. 3, 2006, entitled "Systems and Methods of Forming Particles," by Garstecki, et al., published as U.S. Patent Application Publication No. 2007/0054119 on Mar. 8, 2007; or U.S. patent application Ser. No.

11/885,306, filed Aug. 29, 2007, entitled "Method and Apparatus for Forming Multiple Emulsions," by Weitz, et al., published as U.S. Patent Application Publication No. 2009/0131543 on May 21, 2009, each incorporated herein by reference.

Accordingly, in one set of embodiments of the present invention, a double emulsion is produced, i.e., a carrying fluid, containing an outer fluidic droplet, which in turn contains an inner fluidic droplet therein. In some cases, the carrying fluid and the inner fluid may be the same. These fluids are often of varying miscibilities due to differences in hydrophobicity. For example, the first fluid may be water soluble, the second fluid oil soluble, and the carrying fluid water soluble. This arrangement is often referred to as a w/o/w multiple emulsion ("water/oil/water"). Another multiple emulsion may include a first fluid that is oil soluble, a second fluid that is water soluble, and a carrying fluid that is oil soluble. This type of multiple emulsion is often referred to as an o/w/o multiple emulsion ("oil/water/oil"). It should be noted that the term "oil" in the above terminology merely refers to a fluid that is generally more hydrophobic and not miscible in water, as is known in the art. Thus, the oil may be a hydrocarbon in some embodiments, but in other embodiments, the oil may comprise other hydrophobic fluids. It should also be understood that the water need not be pure; it may be an aqueous solution, for example, a buffer solution, a solution containing a dissolved salt, or the like.

More specifically, as used herein, two fluids are immiscible, or not miscible, with each other when one is not soluble in the other to a level of at least 10% by weight at the temperature and under the conditions at which the emulsion is produced. For instance, two fluids may be selected to be immiscible within the time frame of the formation of the fluidic droplets. In some embodiments, the fluids used to form a multiple emulsion may the same, or different. For example, in some cases, two or more fluids may be used to create a multiple emulsion, and in certain instances, some or all of these fluids may be immiscible. In some embodiments, two fluids used to form a multiple emulsion are compatible, or miscible, while a middle fluid contained between the two fluids is incompatible or immiscible with these two fluids. In other embodiments, however, all three fluids may be mutually immiscible, and in certain cases, all of the fluids do not all necessarily have to be water soluble.

More than two fluids may be used in other embodiments of the invention. Accordingly, certain embodiments of the present invention are generally directed to multiple emulsions, which includes larger fluidic droplets that contain one or more smaller droplets therein which, in some cases, can contain even smaller droplets therein, etc. Any number of nested fluids can be produced, and accordingly, additional third, fourth, fifth, sixth, etc. fluids may be added in some embodiments of the invention to produce increasingly complex droplets within droplets. It should be understood that not all of these fluids necessarily need to be distinguishable; for example, a quadruple emulsion containing oil/water/oil/water or water/oil/water/oil may be prepared, where the two oil phases have the same composition and/or the two water phases have the same composition.

In one set of embodiments, a monodisperse emulsion may be produced, e.g., as noted above. The shape and/or size of the fluidic droplets can be determined, for example, by measuring the average diameter or other characteristic dimension of the droplets. The "average diameter" of a plurality or series of droplets is the arithmetic average of the average diameters of each of the droplets. Those of ordinary skill in the art will be able to determine the average diameter (or other characteristic dimension) of a plurality or series of droplets, for example, using laser light scattering, microscopic examination, or other known techniques. The average diameter of a single droplet, in a non-spherical droplet, is the diameter of a perfect sphere having the same volume as the non-spherical droplet. The average diameter of a droplet (and/or of a plurality or series of droplets) may be, for example, less than about 1 mm, less than about 500 micrometers, less than about 200 micrometers, less than about 100 micrometers, less than about 75 micrometers, less than about 50 micrometers, less than about 25 micrometers, less than about 10 micrometers, or less than about 5 micrometers in some cases. The average diameter may also be at least about 1 micrometer, at least about 2 micrometers, at least about 3 micrometers, at least about 5 micrometers, at least about 10 micrometers, at least about 15 micrometers, or at least about 20 micrometers in certain cases.

The term "determining," as used herein, generally refers to the analysis or measurement of a species, for example, quantitatively or qualitatively, and/or the detection of the presence or absence of the species. "Determining" may also refer to the analysis or measurement of an interaction between two or more species, for example, quantitatively or qualitatively, or by detecting the presence or absence of the interaction. Examples of suitable techniques include, but are not limited to, spectroscopy such as infrared, absorption, fluorescence, UV/visible, FTIR ("Fourier Transform Infrared Spectroscopy"), or Raman; gravimetric techniques; ellipsometry; piezoelectric measurements; immunoassays; electrochemical measurements; optical measurements such as optical density measurements; circular dichroism; light scattering measurements such as quasielectric light scattering; polarimetry; refractometry; or turbidity measurements.

The rate of production of droplets may be determined by the droplet formation frequency, which under many conditions can vary between approximately 100 Hz and 5,000 Hz. In some cases, the rate of droplet production may be at least about 200 Hz, at least about 300 Hz, at least about 500 Hz, at least about 750 Hz, at least about 1,000 Hz, at least about 2,000 Hz, at least about 3,000 Hz, at least about 4,000 Hz, or at least about 5,000 Hz, etc. In addition, production of large quantities of droplets can be facilitated by the parallel use of multiple devices in some instances. In some cases, relatively large numbers of devices may be used in parallel, for example at least about 10 devices, at least about 30 devices, at least about 50 devices, at least about 75 devices, at least about 100 devices, at least about 200 devices, at least about 300 devices, at least about 500 devices, at least about 750 devices, or at least about 1,000 devices or more may be operated in parallel. The devices may comprise different channels, orifices, microfluidics, etc. In some cases, an array of such devices may be formed by stacking the devices horizontally and/or vertically. The devices may be commonly controlled, or separately controlled, and can be provided with common or separate sources of fluids, depending on the application. Examples of such systems are also described in U.S. Provisional Patent Application Ser. No. 61/160,184, filed Mar. 13, 2009, entitled "Scale-up of Microfluidic Devices," by Romanowsky, et al., incorporated herein by reference.

The fluids may be chosen such that the droplets remain discrete, relative to their surroundings. As non-limiting examples, a fluidic droplet may be created having an carrying fluid, containing a first fluidic droplet, containing a second fluidic droplet. In some cases, the carrying fluid and the second fluid may be identical or substantially identical; however, in other cases, the carrying fluid, the first fluid, and the second fluid may be chosen to be essentially mutually immiscible. One non-limiting example of a system involving three essentially mutually immiscible fluids is a silicone oil, a mineral oil, and an aqueous solution (i.e., water, or water containing one or more other species that are dissolved and/or suspended therein, for example, a salt solution, a saline solution, a suspension of water containing particles or cells, or the like). Another example of a system is a silicone oil, a fluorocarbon oil, and an aqueous solution. Yet another example of a system is a hydrocarbon oil (e.g., hexadecane), a fluorocarbon oil, and an aqueous solution. Non-limiting examples of suitable fluorocarbon oils include HFE7500, octadecafluorodecahydronaphthalene:

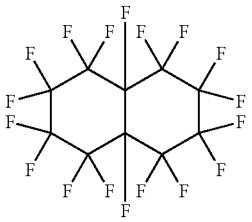

or 1-(1,2,2,3,3,4,4,5,5,6,6-undecafluorocyclohexyl)ethanol:

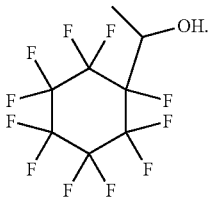

In the descriptions herein, multiple emulsions are often described with reference to a three phase system, i.e., having an outer or carrying fluid, a first fluid, and a second fluid. However, it should be noted that this is by way of example only, and that in other systems, additional fluids may be present within the multiple emulsion droplet. Accordingly, it should be understood that the descriptions such as the carrying fluid, first fluid, and second fluid are by way of ease of presentation, and that the descriptions herein are readily extendable to systems involving additional fluids, e.g., quadruple emulsions, quintuple emulsions, sextuple emulsions, septuple emulsions, etc.

As fluid viscosity can affect droplet formation, in some cases the viscosity of any of the fluids in the fluidic droplets may be adjusted by adding or removing components, such as diluents, that can aid in adjusting viscosity. For example, in some embodiments, the viscosity of the first fluid and the second fluid are equal or substantially equal. This may aid in, for example, an equivalent frequency or rate of droplet formation in the first and second fluids. In other embodiments, the viscosity of the first fluid may be equal or substantially equal to the viscosity of the second fluid, and/or the viscosity of the first fluid may be equal or substantially equal to the viscosity of the carrying fluid. In yet another embodiment, the carrying fluid may exhibit a viscosity that is substantially different from the first fluid. A substantial difference in viscosity means that the difference in viscosity between the two fluids can be measured on a statistically significant basis. Other distributions of fluid viscosities within the droplets are also possible. For example, the second fluid may have a viscosity greater than or less than the viscosity of the first fluid (i.e., the viscosities of the two fluids may be substantially different), the first fluid may have a viscosity that is greater than or less than the viscosity of the carrying fluid, etc. It should also be noted that, in higher-order droplets, e.g., containing four, five, six, or more fluids, the viscosities may also be independently selected as desired, depending on the particular application.

In certain embodiments of the invention, the fluidic droplets (or a portion thereof) may contain additional entities or species, for example, other chemical, biochemical, or biological entities (e.g., dissolved or suspended in the fluid), cells, particles, gases, molecules, pharmaceutical agents, drugs, DNA, RNA, proteins, fragrance, reactive agents, biocides, fungicides, preservatives, chemicals, or the like. Cells, for example, can be suspended in a fluid emulsion. Thus, the species may be any substance that can be contained in any portion of an emulsion. The species may be present in any fluidic droplet, for example, within an inner droplet, within an outer droplet, etc. For instance, one or more cells and/or one or more cell types can be contained in a droplet.

In some embodiments, the fluidic droplets, or portions thereof, may be solidified. For instance, in some cases, a hardened shell may be formed around an inner droplet, such as by using an outer fluid surrounding the inner fluid that can be solidified or gelled. In this way, capsules can be formed with consistently and repeatedly-sized inner droplets, as well as a consistent and repeatedly-sized outer shell. In some embodiments, this can be accomplished by a phase change in the outer fluid. A "phase change" fluid is a fluid that can change phases, e.g., from a liquid to a solid. A phase change can be initiated by a temperature change, for instance, and in some cases the phase change is reversible. For example, a wax or gel may be used as a fluid at a temperature which maintains the wax or gel as a fluid. Upon cooling, the wax or gel can form a solid or semisolid shell, e.g., resulting in a capsule. In another embodiment, the shell can be formed by polymerizing the outer fluid droplet. This can be accomplished in a number of ways, including using a pre-polymer or a monomer that can be catalyzed, for example, chemically, through heat, or via electromagnetic radiation (e.g., ultraviolet radiation) to form a solid polymer shell.

Any technique able to solidify a fluidic droplet into a solid particle can be used. For example, a fluidic droplet, or portion thereof, may be cooled to a temperature below the melting point or glass transition temperature of a fluid within the fluidic droplet, a chemical reaction may be induced that causes the fluid to solidify (for example, a polymerization reaction, a reaction between two fluids that produces a solid product, etc.), or the like.

In one embodiment, the fluidic droplet, or portion thereof, is solidified by reducing the temperature of the fluidic droplet to a temperature that causes at least one of the components of the fluidic droplet to reach a solid state. For example, the fluidic droplet may be solidified by cooling the fluidic droplet to a temperature that is below the melting point or glass transition temperature of a component of the fluidic droplet, thereby causing the fluidic droplet to become solid. As non-limiting examples, the fluidic droplet may be formed at an elevated temperature (i.e., above room temperature, about 25° C.), then cooled, e.g., to room temperature or to a temperature below room temperature; the fluidic droplet may be formed at room temperature, then cooled to a temperature below room temperature, or the like.

In some cases, the fluidic droplet may comprise a material having a sol state and a gel state, such that the conversion of the material from the sol state into a gel state causes the fluidic droplet to solidify. The conversion of the sol state of the material within the fluidic droplet into a gel state may be accomplished through any technique known to those of ordinary skill in the art, for instance, by cooling the fluidic droplet, by initiating a polymeric reaction within the droplet, etc. For example, if the material includes agarose, the fluidic droplet containing the agarose may be produced at a temperature above the gelling temperature of agarose, then subsequently cooled, causing the agarose to enter a gel state. As another example, if the fluidic droplet contains acrylamide (e.g., dissolved within the fluidic droplet), the acrylamide may be polymerized (e.g., using APS and tetramethylethylenediamine) to produce a polymeric particle comprising polyacrylamide.

In another embodiment, the fluidic droplet, or portion thereof, is solidified using a chemical reaction that causes solidification of a fluid to occur. For example, two or more fluids added to a fluidic droplet may react to produce a solid product, thereby causing formation of a solid particle. As another example, a first reactant within the fluidic droplet may be reacted with a second reactant within the liquid surrounding the fluidic droplet to produce a solid, which may thus coat the fluidic droplet within a solid "shell" in some cases, thereby forming a core/shell particle having a solid shell or exterior, and a fluidic core or interior. As yet another example, a polymerization reaction may be initiated within a fluidic droplet, thereby causing the formation of a polymeric particle. For instance, the fluidic droplet may contain one or more monomer or oligomer precursors (e.g., dissolved and/or suspended within the fluidic droplet), which may polymerize to form a polymer that is solid. The polymerization reaction may occur spontaneously, or be initiated in some fashion, e.g., during formation of the fluidic droplet, or after the fluidic droplet has been formed. For instance, the polymerization reaction may be initiated by adding an initiator to the fluidic droplet, by applying light or other electromagnetic energy to the fluidic droplet (e.g., to initiate a photopolymerization reaction), or the like.

A non-limiting example of a solidification reaction is a polymerization reaction involving production of a nylon (e.g., a polyamide), for example, from a diacyl chloride and a diamine. Those of ordinary skill in the art will know of various suitable nylon-production techniques. For example, nylon-6,6 may be produced by reacting adipoyl chloride and 1,6-diaminohexane. For instance, a fluidic droplet may be solidified by reacting adipoyl chloride in the continuous phase with 1,6-diaminohexane within the fluidic droplet, which can react to form nylon-6,6 at the surface of the fluidic droplet. Depending on the reaction conditions, nylon-6,6 may be produced at the surface of the fluidic droplet (forming a particle having a solid exterior and a fluidic interior), or within the fluidic droplet (forming a solid particle).

As discussed, in various aspects of the present invention, multiple emulsions are formed by flowing two, three, or more fluids through various conduits or channels. One or more (or all) of the channels may be microfluidic. "Microfluidic," as used herein, refers to a device, apparatus or system including at least one fluid channel having a cross-sectional dimension of less than about 1 millimeter (mm), and in some cases, a ratio of length to largest cross-sectional dimension of at least 3:1. One or more channels of the system may be a capillary tube. In some cases, multiple channels are provided. The channels may be in the microfluidic size range and may have, for example, average inner diameters, or portions having an inner diameter, of less than about 1 millimeter, less than about 300 micrometers, less than about 100 micrometers, less than about 30 micrometers, less than about 10 micrometers, less than about 3 micrometers, or less than about 1 micrometer, thereby providing droplets having comparable average diameters. One or more of the channels may (but not necessarily), in cross section, have a height that is substantially the same as a width at the same point. In cross-section, the channels may be rectangular or substantially non-rectangular, such as circular or elliptical.

The microfluidic channels may be arranged in any suitable system. As discussed above, in some embodiments, the main channel may be relatively straight, but in other embodiments, a main channel may be curved, angled, bent, or have other shapes. In some embodiments, the microfluidic channels may be arranged in a two dimensional pattern, i.e., such that the positions of the microfluidic channels can be described in two dimensions such that no microfluidic channels cross each other without the fluids therein coming into physical contact with each other, e.g., at an intersection. Of course, such channels, even though represented as a planar array of channels (i.e., in a quasi-two dimensional array of channels), are not truly two-dimensional, but have a length, width and height. In contrast, for instance, a "tube-within-a-tube" configuration would not be quasi-two dimensional, as there is at least one location in which the fluids within two microfluidic channels do not physically come into contact with each other, although they appear to do so in two dimensions.

A "channel," as used herein, means a feature on or in an article (substrate) that at least partially directs flow of a fluid. The channel can have any cross-sectional shape (circular, oval, triangular, irregular, square or rectangular, or the like) and can be covered or uncovered. In embodiments where it is completely covered, at least one portion of the channel can have a cross-section that is completely enclosed, or the entire channel may be completely enclosed along its entire length with the exception of its inlet(s) and/or outlet(s). A channel may also have an aspect ratio (length to average cross sectional dimension) of at least 2:1, more typically at least 3:1, 5:1, 10:1, 15:1, 20:1, or more. An open channel generally will include characteristics that facilitate control over fluid transport, e.g., structural characteristics (an elongated indentation) and/or physical or chemical characteristics (hydrophobicity vs. hydrophilicity) or other characteristics that can exert a force (e.g., a containing force) on a fluid. The fluid within the channel may partially or completely fill the channel. In some cases where an open channel is used, the fluid may be held within the channel, for example, using surface tension (i.e., a concave or convex meniscus).

The channel may be of any size, for example, having a largest dimension perpendicular to fluid flow of less than about 5 mm or 2 mm, or less than about 1 mm, or less than about 500 microns, less than about 200 microns, less than about 100 microns, less than about 60 microns, less than about 50 microns, less than about 40 microns, less than about 30 microns, less than about 25 microns, less than about 10 microns, less than about 3 microns, less than about 1 micron, less than about 300 nm, less than about 100 nm, less than about 30 nm, or less than about 10 nm. In some cases the dimensions of the channel may be chosen such that fluid is able to freely flow through the article or substrate. The dimensions of the channel may also be chosen, for example, to allow a certain volumetric or linear flow rate of fluid in the channel. Of course, the number of channels and the shape of the channels can be varied by any method known to those of ordinary skill in the art. In some cases, more than one channel or capillary may be used. For example, two or more channels may be used, where they are positioned inside each other, positioned adjacent to each other, positioned to intersect with each other, etc.

As discussed, multiple emulsions such as those described herein may be prepared by controlling the hydrophilicity and/or hydrophobicity of the channels used to form the multiple emulsion, according to some (but not all) embodiments. Examples of materials suitable for coating on a channel to control the hydrophilicity and/or hydrophobicity include, but are not limited to, parylene, fluoropolymers such as Viton (a FKM fluorelastomer, DuPont), CYTOP 809A (Sigma Aldrich), Chemraz (a perfluorinated elastomer, available from Fluidigm Corporation), Teflon AF (a polytetrafluoroethylene), tetrafluoromethane ($CF_4$) plasma treatment, fluorinated trichlorosilanes (e.g., $F(CF_2)_y(CH_2)_xSiCl_3$), or the like. Such materials may also, in some cases, increase chemical resistance (e.g., relative to uncoated or untreated channels). In addition, the hydrophilicity and/or hydrophobicity of the materials can be altered using routine techniques known to those of ordinary skill in the art, for example, plasma oxidation (e.g., with oxygen-containing plasma), an oxidant, strong acids or bases, or the like.

In one set of embodiments, the hydrophilicity and/or hydrophobicity of the channels may be controlled by coating a sol-gel onto at least a portion of a channel. For instance, in one embodiment, relatively hydrophilic and relatively hydrophobic portions may be created by applying a sol-gel to the channel surfaces, which renders them relatively hydrophobic. The sol-gel may comprise an initiator, such as a photoinitiator. Portions (e.g., channels, and/or portions of channels) may be rendered relatively hydrophilic by filling the channels with a solution containing a hydrophilic moiety (for example, acrylic acid), and exposing the portions to a suitable trigger for the initiator (for example, light or ultraviolet light in the case of a photoinitiator). For example, the portions may be exposed by using a mask to shield portions in which no reaction is desired, by directed a focused beam of light or heat onto the portions in which reaction is desired, or the like. In the exposed portions, the initiator may cause the reaction (e.g., polymerization) of the hydrophilic moiety to the sol-gel, thereby rendering those portions relatively hydrophilic (for instance, by causing poly(acrylic acid) to become grafted onto the surface of the sol-gel coating in the above example).

As is known to those of ordinary skill in the art, a sol-gel is a material that can be in a sol or a gel state, and typically includes polymers. The gel state typically contains a polymeric network containing a liquid phase, and can be produced from the sol state by removing solvent from the sol, e.g., via drying or heating techniques. In some cases, as discussed below, the sol may be pretreated before being used, for instance, by causing some polymerization to occur within the sol.

In some embodiments, the sol-gel coating may be chosen to have certain properties, for example, having a certain hydrophobicity. The properties of the coating may be controlled by controlling the composition of the sol-gel (for example, by using certain materials or polymers within the sol-gel), and/or by modifying the coating, for instance, by exposing the coating to a polymerization reaction to react a polymer to the sol-gel coating, as discussed below.

For example, the sol-gel coating may be made more hydrophobic by incorporating a hydrophobic polymer in the sol-gel. For instance, the sol-gel may contain one or more silanes, for example, a fluorosilane (i.e., a silane containing at least one fluorine atom) such as heptadecafluorosilane, or other silanes such as methyltriethoxy silane (MTES) or a silane containing one or more lipid chains, such as octadecylsilane or other $CH_3(CH_2)_n$— silanes, where n can be any suitable integer. For instance, n may be greater than 1, 5, or 10, and less than about 20, 25, or 30. The silanes may also optionally include other groups, such as alkoxide groups, for instance, octadecyltrimethoxysilane. In general, most silanes can be used in the sol-gel, with the particular silane being chosen on the basis of desired properties such as hydrophobicity. Other silanes (e.g., having shorter or longer chain lengths) may also be chosen in other embodiments of the invention, depending on factors such as the relative hydrophobicity or hydrophilicity desired. In some cases, the silanes may contain other groups, for example, groups such as amines, which would make the sol-gel more hydrophilic. Non-limiting examples include diamine silane, triamine silane, or N-[3-(trimethoxysilyl)propyl] ethylene diamine silane. The silanes may be reacted to form oligomers or polymers within the sol-gel, and the degree of polymerization (e.g., the lengths of the oligomers or polymers) may be controlled by controlling the reaction conditions, for example by controlling the temperature, amount of acid present, or the like. In some cases, more than one silane may be present in the sol-gel. For instance, the sol-gel may include fluorosilanes to cause the resulting sol-gel to exhibit greater hydrophobicity, and other silanes (or other compounds) that facilitate the production of polymers. In some cases, materials able to produce $SiO_2$ compounds to facilitate polymerization may be present, for example, TEOS (tetraethyl orthosilicate).

It should be understood that the sol-gel is not limited to containing only silanes, and other materials may be present in addition to, or in place of, the silanes. For instance, the coating may include one or more metal oxides, such as $SiO_2$, vanadia ($V_2O_5$), titania ($TiO_2$), and/or alumina ($Al_2O_3$).

In some instances, the microfluidic channel is present in a material suitable to receive the sol-gel, for example, glass, metal oxides, or polymers such as polydimethylsiloxane (PDMS) and other siloxane polymers. For example, in some cases, the microfluidic channel may be one in which contains silicon atoms, and in certain instances, the microfluidic channel may be chosen such that it contains silanol (Si—OH) groups, or can be modified to have silanol groups. For instance, the microfluidic channel may be exposed to an oxygen plasma, an oxidant, or a strong acid cause the formation of silanol groups on the microfluidic channel.

The sol-gel may be present as a coating on the microfluidic channel, and the coating may have any suitable thickness. For instance, the coating may have a thickness of no more than about 100 micrometers, no more than about 30 micrometers, no more than about 10 micrometers, no more than about 3 micrometers, or no more than about 1 micrometer. Thicker coatings may be desirable in some cases, for instance, in applications in which higher chemical resistance is desired. However, thinner coatings may be desirable in other applications, for instance, within relatively small microfluidic channels.

In one set of embodiments, the hydrophobicity of the sol-gel coating can be controlled, for instance, such that a first portion of the sol-gel coating is relatively hydrophobic, and a second portion of the sol-gel coating is relatively hydrophilic. The hydrophobicity of the coating can be determined using techniques known to those of ordinary skill in the art, for example, using contact angle measurements such as those discussed herein. For instance, in some cases, a first portion of a microfluidic channel may have a hydrophobicity that favors an organic solvent to water, while a second portion may have a hydrophobicity that favors water to the organic solvent.

The hydrophobicity of the sol-gel coating can be modified, for instance, by exposing at least a portion of the sol-gel coating to a polymerization reaction to react a polymer to the sol-gel coating. The polymer reacted to the sol-gel coating may be any suitable polymer, and may be chosen to have certain hydrophobicity properties. For instance, the polymer may be chosen to be more hydrophobic or more hydrophilic than the microfluidic channel and/or the sol-gel coating. As an example, a hydrophilic polymer that could be used is poly(acrylic acid).

The polymer may be added to the sol-gel coating by supplying the polymer in monomeric (or oligomeric) form to the sol-gel coating (e.g., in solution), and causing a polymerization reaction to occur between the monomer and the sol-gel. For instance, free radical polymerization may be used to cause bonding of the polymer to the sol-gel coating. In some embodiments, a reaction such as free radical polymerization may be initiated by exposing the reactants to heat and/or light, such as ultraviolet (UV) light, optionally in the presence of a photoinitiator able to produce free radicals (e.g., via molecular cleavage) upon exposure to light. Those of ordinary skill in the art will be aware of many such photoinitiators, many of which are commercially available, such as Irgacur 2959 (Ciba Specialty Chemicals) or 2-hydroxy-4-(3-triethoxysilylpropoxy)-diphenylketone (SIH6200.0, ABCR GmbH & Co. KG).

The photoinitiator may be included with the polymer added to the sol-gel coating, or in some cases, the photoinitiator may be present within the sol-gel coating. For instance, a photoinitiator may be contained within the sol-gel coating, and activated upon exposure to light. The photoinitiator may also be conjugated or bonded to a component of the sol-gel coating, for example, to a silane. As an example, a photoinitiator such as Irgacur 2959 may be conjugated to a silane-isocyanate via a urethane bond, where a primary alcohol on the photoinitiator may participate in nucleophilic addition with the isocyanate group, which may produce a urethane bond.

It should be noted that only a portion of the sol-gel coating may be reacted with a polymer, in some embodiments of the invention. For instance, the monomer and/or the photoinitiator may be exposed to only a portion of the microfluidic channel, or the polymerization reaction may be initiated in only a portion of the microfluidic channel. As a particular example, a portion of the microfluidic channel may be exposed to light, while other portions are prevented from being exposed to light, for instance, by the use of masks or filters, or by using a focused beam of light. Accordingly, different portions of the microfluidic channel may exhibit different hydrophobicities, as polymerization does not occur everywhere on the microfluidic channel. As another example, the microfluidic channel may be exposed to UV light by projecting a de-magnified image of an exposure pattern onto the microfluidic channel. In some cases, small resolutions (e.g., 1 micrometer, or less) may be achieved by projection techniques.

Another aspect of the present invention is generally directed at systems and methods for coating such a sol-gel onto at least a portion of a microfluidic channel. In one set of embodiments, a microfluidic channel is exposed to a sol, which is then treated to form a sol-gel coating. In some cases, the sol can also be pretreated to cause partial polymerization to occur. Extra sol-gel coating may optionally be removed from the microfluidic channel. In some cases, as discussed, a portion of the coating may be treated to alter its hydrophobicity (or other properties), for instance, by exposing the coating to a solution containing a monomer and/or an oligomer, and causing polymerization of the monomer and/or oligomer to occur with the coating.

The sol may be contained within a solvent, which can also contain other compounds such as photoinitiators including those described above. In some cases, the sol may also comprise one or more silane compounds. The sol may be treated to form a gel using any suitable technique, for example, by removing the solvent using chemical or physical techniques, such as heat. For instance, the sol may be exposed to a temperature of at least about 150° C., at least about 200° C., or at least about 250° C., which may be used to drive off or vaporize at least some of the solvent. As a specific example, the sol may be exposed to a hotplate set to reach a temperature of at least about 200° C. or at least about 250° C., and exposure of the sol to the hotplate may cause at least some of the solvent to be driven off or vaporized. In some cases, however, the sol-gel reaction may proceed even in the absence of heat, e.g., at room temperature. Thus, for instance, the sol may be left alone for a while (e.g., about an hour, about a day, etc.), and/or air or other gases may be passed over the sol, to allow the sol-gel reaction to proceed.

In some cases, any ungelled sol that is still present may be removed from the microfluidic channel. The ungelled sol may be actively removed, e.g., physically, by the application of pressure or the addition of a compound to the microfluidic channel, etc., or the ungelled sol may be removed passively in some cases. For instance, in some embodiments, a sol present within a microfluidic channel may be heated to vaporize solvent, which builds up in a gaseous state within the microfluidic channels, thereby increasing pressure within the microfluidic channels. The pressure, in some cases, may be enough to cause at least some of the ungelled sol to be removed or "blown" out of the microfluidic channels.

In certain embodiments, the sol is pretreated to cause partial polymerization to occur, prior to exposure to the microfluidic channel. For instance, the sol may be treated such that partial polymerization occurs within the sol. The sol may be treated, for example, by exposing the sol to an acid or temperatures that are sufficient to cause at least some gellation to occur. In some cases, the temperature may be less than the temperature the sol will be exposed to when added to the microfluidic channel. Some polymerization of the sol may occur, but the polymerization may be stopped before reaching completion, for instance, by reducing the temperature. Thus, within the sol, some oligomers may form (which may not necessarily be well-characterized in terms of length), although full polymerization has not yet occurred. The partially treated sol may then be added to the microfluidic channel, as discussed above.

In certain embodiments, a portion of the coating may be treated to alter its hydrophobicity (or other properties) after the coating has been introduced to the microfluidic channel. In some cases, the coating is exposed to a solution containing a monomer and/or an oligomer, which is then polymerized to bond to the coating, as discussed above. For instance, a portion of the coating may be exposed to heat or to light such as ultraviolet right, which may be used to initiate a free radical polymerization reaction to cause polymerization to occur. Optionally, a photoinitiator may be present, e.g., within the sol-gel coating, to facilitate this reaction.

Additional details of such coatings and other systems may be seen in U.S. Provisional Patent Application Ser. No. 61/040,442, filed Mar. 28, 2008, entitled "Surfaces, Including Microfluidic Channels, With Controlled Wetting Properties," by Abate, et al.; and International Patent Application Serial No. PCT/US2009/000850, filed Feb. 11, 2009, entitled "Surfaces, Including Microfluidic Channels, With Controlled Wetting Properties," by Abate, et al., published as WO 2009/120254 on Oct. 1, 2009, each incorporated herein by reference.

A variety of materials and methods, according to certain aspects of the invention, can be used to form systems (such as those described above) able to produce the multiple droplets described herein. In some cases, the various materials selected lend themselves to various methods. For example, various components of the invention can be formed from solid materials, in which the channels can be formed via micromachining, film deposition processes such as spin coating and chemical vapor deposition, laser fabrication, photolithographic techniques, etching methods including wet chemical or plasma processes, and the like. See, for example, *Scientific American,* 248:44-55, 1983 (Angell, et al). In one embodiment, at least a portion of the fluidic system is formed of silicon by etching features in a silicon chip. Technologies for precise and efficient fabrication of various fluidic systems and devices of the invention from silicon are known. In another embodiment, various components of the systems and devices of the invention can be formed of a polymer, for example, an elastomeric polymer such as polydimethylsiloxane ("PDMS"), polytetrafluoroethylene ("PTFE" or Teflon®), or the like.

Different components can be fabricated of different materials. For example, a base portion including a bottom wall and side walls can be fabricated from an opaque material such as silicon or PDMS, and a top portion can be fabricated from a transparent or at least partially transparent material, such as glass or a transparent polymer, for observation and/or control of the fluidic process. Components can be coated so as to expose a desired chemical functionality to fluids that contact interior channel walls, where the base supporting material does not have a precise, desired functionality. For example, components can be fabricated as illustrated, with interior channel walls coated with another material. Material used to fabricate various components of the systems and devices of the invention, e.g., materials used to coat interior walls of fluid channels, may desirably be selected from among those materials that will not adversely affect or be affected by fluid flowing through the fluidic system, e.g., material(s) that is chemically inert in the presence of fluids to be used within the device. A non-limiting example of such a coating was previously discussed.

In one embodiment, various components of the invention are fabricated from polymeric and/or flexible and/or elastomeric materials, and can be conveniently formed of a hardenable fluid, facilitating fabrication via molding (e.g. replica molding, injection molding, cast molding, etc.). The hardenable fluid can be essentially any fluid that can be induced to solidify, or that spontaneously solidifies, into a solid capable of containing and/or transporting fluids contemplated for use in and with the fluidic network. In one embodiment, the hardenable fluid comprises a polymeric liquid or a liquid polymeric precursor (i.e. a "prepolymer"). Suitable polymeric liquids can include, for example, thermoplastic polymers, thermoset polymers, or mixture of such polymers heated above their melting point. As another example, a suitable polymeric liquid may include a solution of one or more polymers in a suitable solvent, which solution forms a solid polymeric material upon removal of the solvent, for example, by evaporation. Such polymeric materials, which can be solidified from, for example, a melt state or by solvent evaporation, are well known to those of ordinary skill in the art. A variety of polymeric materials, many of which are elastomeric, are suitable, and are also suitable for forming molds or mold masters, for embodiments where one or both of the mold masters is composed of an elastomeric material. A non-limiting list of examples of such polymers includes polymers of the general classes of silicone polymers, epoxy polymers, and acrylate polymers. Epoxy polymers are characterized by the presence of a three-membered cyclic ether group commonly referred to as an epoxy group, 1,2-epoxide, or oxirane. For example, diglycidyl ethers of bisphenol A can be used, in addition to compounds based on aromatic amine, triazine, and cycloaliphatic backbones. Another example includes the well-known Novolac polymers. Non-limiting examples of silicone elastomers suitable for use according to the invention include those formed from precursors including the chlorosilanes such as methylchlorosilanes, ethylchlorosilanes, phenylchlorosilanes, etc.

Silicone polymers are preferred in one set of embodiments, for example, the silicone elastomer polydimethylsiloxane. Non-limiting examples of PDMS polymers include those sold under the trademark Sylgard by Dow Chemical Co., Midland, Mich., and particularly Sylgard 182, Sylgard 184, and Sylgard 186. Silicone polymers including PDMS have several beneficial properties simplifying fabrication of the microfluidic structures of the invention. For instance, such materials are inexpensive, readily available, and can be solidified from a prepolymeric liquid via curing with heat. For example, PDMSs are typically curable by exposure of the prepolymeric liquid to temperatures of about, for example, about 65° C. to about 75° C. for exposure times of, for example, about an hour. Also, silicone polymers, such as PDMS, can be elastomeric, and thus may be useful for forming very small features with relatively high aspect ratios, necessary in certain embodiments of the invention. Flexible (e.g., elastomeric) molds or masters can be advantageous in this regard.

One advantage of forming structures such as microfluidic structures of the invention from silicone polymers, such as PDMS, is the ability of such polymers to be oxidized, for example by exposure to an oxygen-containing plasma such as an air plasma, so that the oxidized structures contain, at their surface, chemical groups capable of cross-linking to other oxidized silicone polymer surfaces or to the oxidized surfaces of a variety of other polymeric and non-polymeric materials. Thus, components can be fabricated and then oxidized and essentially irreversibly sealed to other silicone polymer surfaces, or to the surfaces of other substrates reactive with the oxidized silicone polymer surfaces, without the need for separate adhesives or other sealing means. In most cases, sealing can be completed simply by contacting an oxidized silicone surface to another surface without the need to apply auxiliary pressure to form the seal. That is, the pre-oxidized silicone surface acts as a contact adhesive against suitable mating surfaces. Specifically, in addition to being irreversibly sealable to itself, oxidized silicone such as oxidized PDMS can also be sealed irreversibly to a range of oxidized materials other than itself including, for example, glass, silicon, silicon oxide, quartz, silicon nitride, polyethylene, polystyrene, glassy carbon, and epoxy polymers, which have been oxidized in a similar fashion to the PDMS surface (for example, via exposure to an oxygen-containing plasma). Oxidation and sealing methods useful in the context of the present invention, as well as overall molding techniques, are described in the art, for example, in an article entitled "Rapid Prototyping of Microfluidic Systems and Polydimethylsiloxane," *Anal. Chem.,* 70:474-480, 1998 (Duffy, et al.), incorporated herein by reference.

In some embodiments, certain microfluidic structures of the invention (or interior, fluid-contacting surfaces) may be formed from certain oxidized silicone polymers. Such surfaces may be more hydrophilic than the surface of an elastomeric polymer. Such hydrophilic channel surfaces can thus be more easily filled and wetted with aqueous solutions.

In one embodiment, a bottom wall of a microfluidic device of the invention is formed of a material different from one or more side walls or a top wall, or other components. For example, the interior surface of a bottom wall can comprise the surface of a silicon wafer or microchip, or other substrate. Other components can, as described above, be sealed to such alternative substrates. Where it is desired to seal a component comprising a silicone polymer (e.g. PDMS) to a substrate (bottom wall) of different material, the substrate may be selected from the group of materials to which oxidized silicone polymer is able to irreversibly seal (e.g., glass, silicon, silicon oxide, quartz, silicon nitride, polyethylene, polystyrene, epoxy polymers, and glassy carbon surfaces which have been oxidized). Alternatively, other sealing techniques can be used, as would be apparent to those of ordinary skill in the art, including, but not limited to, the use of separate adhesives, bonding, solvent bonding, ultrasonic welding, etc.

The following applications are each incorporated herein by reference: U.S. patent application Ser. No. 08/131,841, filed Oct. 4, 1993, entitled "Formation of Microstamped Patterns on Surfaces and Derivative Articles," by Kumar, et al., now U.S. Pat. No. 5,512,131, issued Apr. 30, 1996; U.S. patent application Ser. No. 09/004,583, filed Jan. 8, 1998, entitled "Method of Forming Articles including Waveguides via Capillary Micromolding and Microtransfer Molding," by Kim, et al., now U.S. Pat. No. 6,355,198, issued Mar. 12, 2002; International Patent Application No. PCT/US96/03073, filed Mar. 1, 1996, entitled "Microcontact Printing on Surfaces and Derivative Articles," by Whitesides, et al., published as WO 96/29629 on Jun. 26, 1996; International Patent Application No.: PCT/US01/16973, filed May 25, 2001, entitled "Microfluidic Systems including Three-Dimensionally Arrayed Channel Networks," by Anderson, et al., published as WO 01/89787 on Nov. 29, 2001; U.S. patent application Ser. No. 11/246,911, filed Oct. 7, 2005, entitled "Formation and Control of Fluidic Species," by Link, et al., published as U.S. Patent Application Publication No. 2006/0163385 on Jul. 27, 2006; U.S. patent application Ser. No. 11/024,228, filed Dec. 28, 2004, entitled "Method and Apparatus for Fluid Dispersion," by Stone, et al., published as U.S. Patent Application Publication No. 2005/0172476 on Aug. 11, 2005; International Patent Application No. PCT/US2006/007772, filed Mar. 3, 2006, entitled "Method and Apparatus for Forming Multiple Emulsions," by Weitz, et al., published as WO 2006/096571 on Sep. 14, 2006; U.S. patent application Ser. No. 11/360,845, filed Feb. 23, 2006, entitled "Electronic Control of Fluidic Species," by Link, et al., published as U.S. Patent Application Publication No. 2007/000342 on Jan. 4, 2007; and U.S. patent application Ser. No. 11/368,263, filed Mar. 3, 2006, entitled "Systems and Methods of Forming Particles," by Garstecki, et al. Also incorporated herein by reference are U.S. Provisional Patent Application Ser. No. 60/920,574, filed Mar. 28, 2007, entitled "Multiple Emulsions and Techniques for Formation," by Chu, et al. Also incorporated herein by reference are U.S. Provisional Patent Application Ser. No. 61/239,402, filed on Sep. 22, 2009, entitled "Multiple Emulsions Created Using Junctions," by Weitz, et al.; U.S. Provisional Patent Application Ser. No. 61/239,405, filed on Sep. 22, 2009, entitled "Multiple Emulsions Created Using Jetting and Other Techniques," by Weitz, et al.; and U.S. Provisional Patent Application Ser. No. 61/353,093, filed Jun. 9, 2010, entitled "Multiple Emulsions Created Using Jetting and Other Techniques," by Weitz, et al.

The following examples are intended to illustrate certain embodiments of the present invention, but do not exemplify the full scope of the invention.

Example 1

This example presents a technique for forming double emulsions in a one-step process in lithographically fabricated devices. The devices allow the formation of a stable, nested jet of a first, active phase inside a middle phase. This nested jet is delivered to a second junction where the channels widen and continuous phase is added; this creates an instability at the entrance of the junction, which causes jet to break into monodisperse double emulsions in a dripping process. This process produces double emulsions, which may be relatively thin-shelled in some cases.

In this example, the microfluidic devices were fabricated in PDMS using the techniques of soft-lithography. To enable formation of double emulsions, the channels were spatially patterned using a photoreactive sol-gel coating. To pattern wettability, the devices were coated with the sol-gel, filled with acrylic acid monomer solution, and exposed to patterned UV-light. Wherever the devices are exposed to the light, polyacrylic acid chains were grafted to the interface making them hydrophilic; the default properties of the sol-gel made the rest of the device hydrophobic. See, e.g., International Patent Application No. PCT/US2009/000850, filed Feb. 11, 2009, entitled "Surfaces, Including Microfluidic Channels, with Controlled Wetting Properties," by Abate, et al.; and International Patent Application No. PCT/US2008/009477, filed Aug. 7, 2008, entitled "Metal Oxide Coating on Surfaces," by Weitz, et al., published as WO 2009/020633 on Feb. 12, 2009 for more information, each of which is incorporated herein by reference in their entireties. As solutions for the double emulsions, distilled water was used with surfactant sodium dodecyl sulfate (SDS) at 0.5% and HFE-7500 fluorocarbon oil with surfactant R22 at 1.8%. All double emulsions used in this example were composed of fluorocarbon oil inner droplets and water shells, dispersed in fluorocarbon oil continuous phase. FIG. 2 shows a schematic diagram of the device used in this example.

The devices used in this example included cross-channel junctions connected in series. The first junction was used as a jetting junction and the second or third junction was used as a dripping junction. In this example, the device was used by first forming a concentric jet of the inner phase nested inside the middle phase, and then breaking the jet into double emulsions in a one-step dripping process. This was achieved by controlling the Weber numbers in the two junctions. The Weber number is defined as $We=\rho\ u^2/\gamma\ l^3$, where $\rho$ (rho)=1614 kg/m$^3$ is the density of the fluid, u the volumetric flow rate of fluid, w is the width of the channel, and $\gamma$ (gamma)=1.5 m N/m the surface tension between the dispersed and continuous phase. This equation governs the transition from dripping to jetting for co-flowing laminar streams such that for We<1, the system drips and for We>1, the system jets. Therefore, to allow controlled jet formation in the first junction, a short, narrow nozzle was used so that w remained small; in this case, 40 micrometers. For these dimensions, the Weber number approached one from below as the inner phase flow rates increases to 1600 microliters/hr; above this flow rate the system exhibited jetting. To allow controlled, one-step dripping of the nested jet, the nozzle of the second junction was widened. This slowed the flow velocity, reducing We, so that the system exhibits dripping. This allowed the nested jet to break into monodisperse double emulsions up to $u_m+u_{mid}$=3200 microliters/hr, allowing formation of double emulsions with a variety of thicknesses.

The We number thus governs not only the transition from dripping to jetting, but also whether the double emulsification occurs in a one-step or two-step process in this device. To illustrate this, We was varied in the first junction to navigate between the two regimes, as shown in FIG. 3. This figure shows optical microscopy images of double emulsions formed in a dual-junction device for a range of Weber numbers. We was started small by setting the flow rates to 600 microliters/hr for the inner, 1000 microliters/hr for the middle phase, and 1800 and 200 microliters/hr for the continuous phases. At these flow rates We=0.37 for the first junction, so that the system exhibiting dripping, as shown in FIG. 3. These droplets flowed into the second junction where they were encapsulated in the outer droplets, producing double emulsions in a two-step process, as shown in FIG. 3. As We was slowly increased, the system remained in a dripping regime, producing double emulsions in a two-step process, but at a faster rate with relatively thinner shells, as shown in the middle range in FIG. 3. As We was increased even more, the double emulsions were produced even more quickly with even thinner shells, up to We~1, when the first droplet maker began to exhibiting jetting, as shown in FIG. 3. At this point, droplet formation transitioned from being a two-step process to a one-step process, forming very thin-shelled double emulsions, as shown to the right in FIG. 3. Close to the transition, however, the double emulsions did not appear to be perfectly monodisperse because the inner phase jet did not appeal to be completely stable; convective instabilities deformed the jet, causing it to become thicker and thinner in places. To achieve increased monodisperse double emulsions, We was increased to move further away from the dripping/jetting transition. At these flow rates, convective instabilities may be swept downstream faster sufficiently rapidly to avoid interference with the jet, yielding a smooth, stable jet with a time invariant shape. This allowed the instability at the entrance of the second nozzle to pinch the jet off into relatively monodisperse double emulsions, as depicted in FIG. 3. Increasing We even further in some cases may lead to the formation of polydisperse double emulsions as the flow rates became sufficiently large that the second junction also began to exhibit jetting behavior.

Figure 4A:
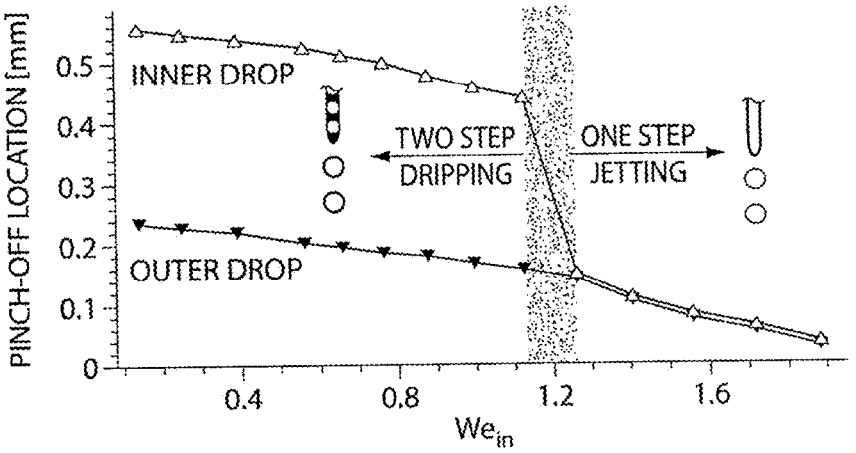
FIGS. 4A-4B show data illustrating control of droplet formation, in another embodiment of the invention.

To quantify the transition from two-step to one-step double emulsification, the pinch-off locations of the inner and outer droplets as a function of We was determined, as shown in FIG. 4A. At small We there was a large separation distance between the inner and outer droplet formation, since the process was two-step, as shown in FIG. 4A. As We increased there was a relatively sudden, discontinuous jump in the pinch-off location of the inner drop, as the inner phase jets into the second junction, as shown in FIG. 4A. At these flow rates, the inner and outer droplets pinched off at nearly the same place and time, resulting in one-step droplet formation, as shown in FIG. 4A. The thickness of the double emulsion shells also steadily decreased over this range, because the flow rate ratio of the inner-to-middle phase increased, as shown by the comparison with the theoretical curve for shell thickness in FIG. 4B (showing the thickness of the resulting double emulsion shell, as a function of the inner-phase Weber number). At low inner phase flow rates, thick-shelled double emulsions were formed, whereas at high inner phase flow rates thin shelled double emulsions were formed. This allowed the structure of the double emulsions to be controlled by adjusting flow rates. In particular, at We~1 the first junction transitioned from dripping to jetting behavior, so that there was a discontinuous jump in the pinch-off location of the inner drop; this also set the transition from two-step formation at low We to one-step formation at high We. The shell thickness can be modeled as a function of We, as shown by the equation inset in FIG. 4B.

Figure 5A:
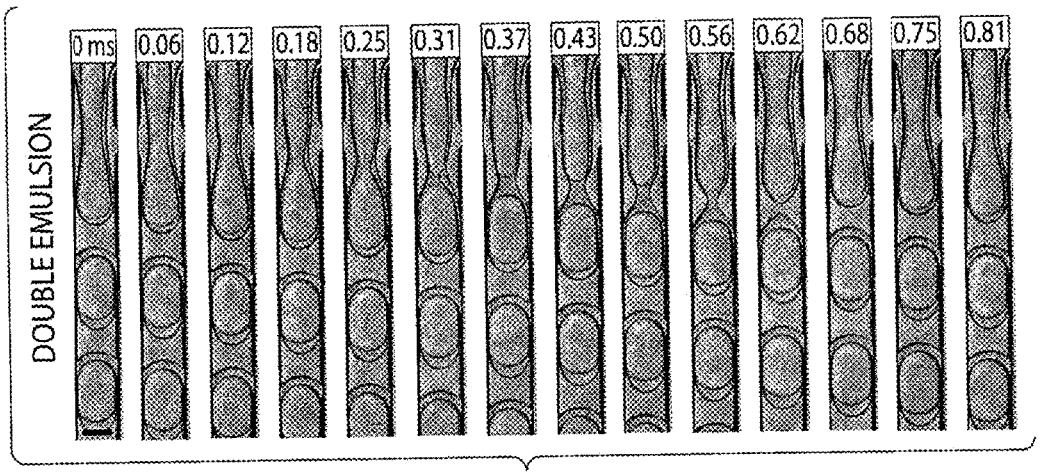
FIGS. 5A-5B shows various optical microscopy images illustrating the formation of a double and triple emulsions, in certain embodiments of the invention.

To observe the continuous dynamics of one-step double emulsification, images of the process were recorded with a high-speed camera. The flow rates of the device were set to 1900 microliters/hr for the inner, 1000 microliters/hr for the middle, and 1800 and 200 microliters/hr for the continuous phases. At these flow rates the double emulsions were formed at a rate of about 3 kHz, so that to resolve the continuous dynamics, the images were recorded at 16 kHz. Just as with emulsification of a single-phase fluid in a confining microchannel, the front part of the jet extended into the nozzle and blocked it, as shown for t=0 and 62 microseconds, as shown in FIG. 5A. This caused the pressure to increase in the continuous phase, which started squeezing on the jet. This caused the jet to narrow, as shown for t=125 and 187 microseconds. Just as the continuous phase squeezes on the middle phase, the middle phase also squeezed on the inner phase, as shown for t=250 microseconds. At t=312 microseconds, this caused the inner droplet to pinch-off, but the middle phase remains connected for another 300 microseconds. At t=625 microseconds the middle phase too pinches-off, completing formation of the double emulsion. The process repeats cyclically, creating relatively monodisperse double emulsions with thin shells. One-step double emulsification thus actually occurs through two pinch-off events, but they are separated by 300 microseconds in time and 80 micrometers in space in this example device.

Example 2

This example illustrates a simple way to create multiple emulsions with a wide range of shell thicknesses. A microfluidic device was used to create a multiple jet of immiscible fluids; using a dripping instability, the jet was broken into multiple emulsions. By controlling the thickness of the jets, the thickness of the shells in the multiple emulsions could be controlled. As shown in this example, one-step formation is an effective way to create monodisperse emulsions from fluids that cannot be emulsified controllably otherwise, such as viscoelastic fluids.

In this example, a simple technique to form multiple emulsions with a wide range of shell thicknesses is presented. A microfluidic device having a series of flow-focusing junctions was used. By setting the flow rates such that all but the final junction was in the jetting regime, a multiple jet of the different fluids could be produced. The multiple jet was broken into multiple emulsions in the final junction using a dripping instability. Because this does not require the flow rates to be set such that all junctions are in the dripping regime, it can operate over a much wider range, allowing production of multiple emulsions with a wider range of shell thicknesses. This is also an effective way to create monodisperse drops from fluids that normally cannot be emulsified in microfluidic devices, such as viscoelastic fluids. This was achieved in this example by wrapping the "difficult" fluid in a fluid that was easier to emulsify, forming a double jet. By inducing the outer jet to pinch into drops, the inner jet could also be pinched into drops. By breaking the double emulsions, the inner drops could be released, yielding a monodisperse emulsion of the difficult fluid.

Microfluidic flow-focusing was used to create the emulsions in this example. A flow-focus device having two channels intersecting at right angles to form a four-way cross was used. The dispersed phase was injected into the central inlet and the continuous phase into the inlets on either side. The two fluids met in the nozzle. As the fluids flowed through the nozzle, shear was generated; this caused the dispersed phase to form a jet surrounded by the continuous phase. Depending on flow conditions, the jet could be stable, i.e., in which it does not break into drops, or unstable, in which it does. The flow conditions that lead to drop formation could be described by two dimensionless numbers. The Weber number of the dispersed fluid, $We_{in}=\rho\ v^2\ l/\gamma$, relates the magnitude of the inertia of the jet to its surface tension; ρ (rho) and v are the density and velocity of the inner phase, l is the diameter of the channel, and γ (gamma) is the surface tension of the jet. The Capillary number of the outer phase, $Ca_{out}=\mu\ v/\gamma$, relates the magnitude of the shear on the jet due to the continuous phase, to its surface tension; μ and v are the viscosity and velocity of the outer phase and γ is the surface tension of the jet. For $\{We_{in}, Ca_{out}\}>1$, the dispersed phase formed jets that did not break into monodisperse drops. For $\{5\ Ca_{out}\}<1$, a dripping instability was present, wherein the dispersed phase broke into monodisperse drops.

Figure 6A:
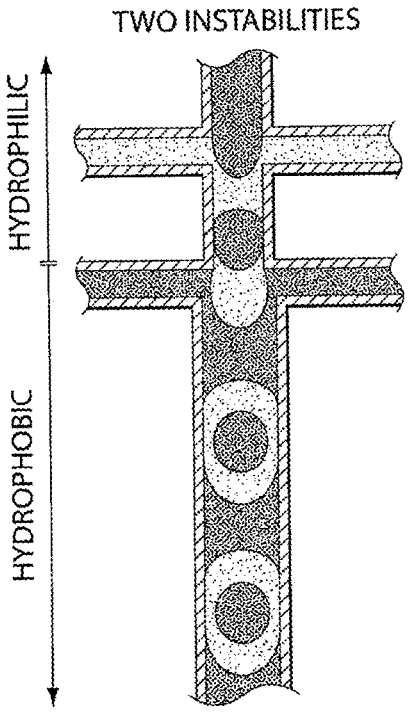
FIGS. 6A-6B illustrate different droplet creation techniques, according to various aspects of the invention.
Figure 6B:
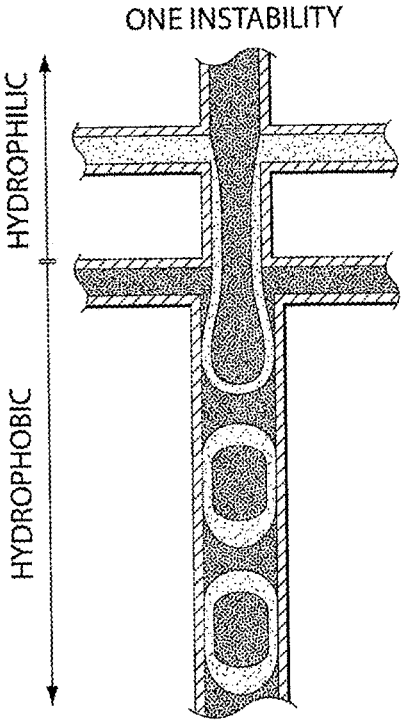

When forming double emulsions, two flow-focus junctions were used in series. The outlet of the first junction fed into the inlet of the next, as shown in FIG. 6A. Normally, dripping instabilities were present in both junctions. This produced double emulsions in a two-step process; the inner drop was formed in the first junction and encapsulated in the outer drop in the second junction. Double emulsions could also be formed in a one-step process by removing the first dripping instability, by increasing the flow rates in the first junction. This produced a stable jet of the inner phase that extends into the second junction. There, it was surrounded by a layer of middle phase, producing a double jet, as illustrated in FIG. 6B. If the flow rates in the second junction were set such that a dripping instability is present, the double jet would be pinched into double emulsions, as depicted in FIG. 6B.

To demonstrate this ability to control the formation process with dripping instabilities, a double flow-focus microfluidic device was constructed. The device was fabricated at a constant channel height of 50 micrometers. As fluids for the double emulsions, distilled water with SDS at 0.5% by weight, and HFE-7500 fluorocarbon oil with the ammonium carboxylate of Krytox 157 FSL at 1.8% by weight were used. To form O/W/O double emulsions, the wettability of the device was patterned such that the first junction was hydrophilic and the second junction was hydrophobic. To pattern wettability, a simple flow-confinement technique was used.

A double emulsion was formed with the two-step process. This required two dripping instabilities, one in each junction. The flow rates were set to 600 microliters/h for the inner phase, 1000 microliters/h for the middle phase, and 2500 microliters/h for the continuous phase, ensuring that $\{We_{in}, Ca_{out}\}<1$ in both junctions. This caused the inner phase to drip in the first junction, and the middle phase to drip in the second, forming double emulsions in a two-step process, as shown for $We_{in}=0.2$ in FIG. 3. As $We_{in}$ was increased, the first flow-focus junction was brought closer to the jetting regime, although the process remained two-step, as shown for $We_{in}=0.8$ in FIG. 3. As $We_{in}$ was increased above 1, the inner phase suddenly jetted; this produced a double jet in the second junction, as shown for $We_{in}=1.1$ in FIG. 3. Because $\{We_{in}, Ca_{out}\}<1$ in the second junction, a dripping instability remained, breaking the double jet into double emulsions, as shown in FIG. 3. In FIG. 3, for low $We_{in}$, dripping instabilities were present in both flow-focus junctions, forming double emulsions in a two-step process. However, when $We_{in}$, was increased beyond 1, the first instability is removed; this caused the inner phase to jet into the second junction, forming a double jet that breaks into double emulsions in a one-step process. The scale bars in FIG. 3 denote 50 micrometers.

Figure 4B:
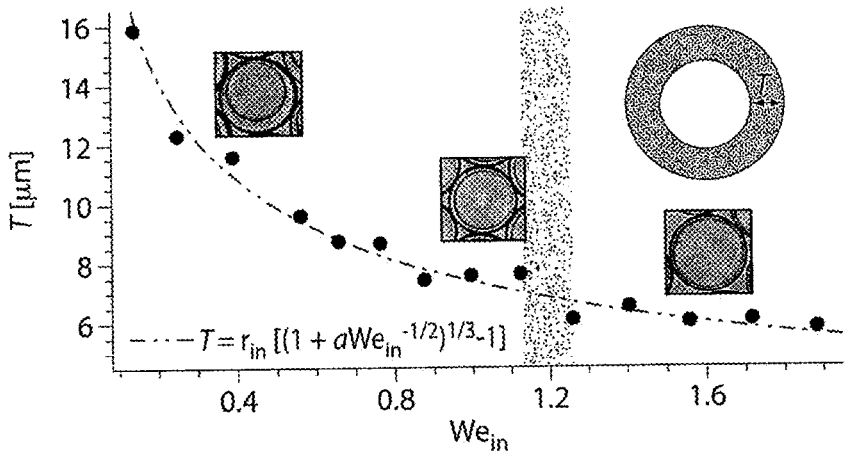

To quantify the transition between the two-step and one-step formation processes, the pinch-off locations of the inner and outer drops was determined. At low $We_{in}$, the inner and middle phases pinched off at different locations, because there were two spatially-separated dripping instabilities, as shown in FIG. 4A. As $We_{in}$ was increased, both pinch-off locations were displaced downstream, due to the larger shear that was generated by the higher flow rates, though the process remained two-step, as shown in FIG. 4A. As $We_{in}$ was increased beyond 1, the inner phase jets; the inner and middle phases pinched off at nearly the same place, as shown in FIG. 4A. The transition between these regimes was sudden, possibly due to the sudden nature of the dripping-to-jetting transition. Over this range of $We_{in}$, the shell thicknesses of the double emulsions decreased because the fraction of inner-to-middle phase increased, as shown in FIG. 4B. In the two-step formation process, shells thinner than 7 micrometers could not always be formed because to do so would require flow rates that would typically not produce drops; however, by designing the device to operate in the one-step regime, the device can utilize these flow rates. This allowed the inner-to-middle phase volume fraction to be increased almost arbitrarily, producing exceedingly thin-shelled double emulsions, as shown in FIG. 4B.

In FIG. 4A, at low $We_{in}$, dripping instabilities were present in both flow-focus junctions, so that the inner and outer jets broke at different locations. However, as $We_{in}$, was increased beyond 1, the inner phase jetted into the second junction; this produced a double jet in which the inner and outer phases pinched off at the same place. FIG. 4B shows that the thickness of the double emulsion shells decreased over this range, possibly because the fraction of inner-to-middle phase increased. One step formation accordingly can be used to produce double emulsions with shells much thinner than multi-step formation because it is not limited to flow rates in which the first flow-focus junction is in the dripping regime.

To visualize the dynamics of the one-step formation of double emulsions, the process was recorded as a movie with a high-speed camera. Early in the drop formation cycle the double jet extended into the flow-focus junctions, where the dripping instability is as shown for t=0 microseconds in FIG. 5A. As the cycle progressed, the dripping instability caused the double jet to narrow. Since the inner jet is thinner than the outer jet, it reached an unstable width sooner; this caused it to pinch into a drop while the outer jet remained connected, as shown for t=375 microseconds. As the cycle progressed the outer jet continued to narrow, to the point that it also reached an unstable width and broke, producing a double emulsion, t=625 microseconds.

Figure 5B:
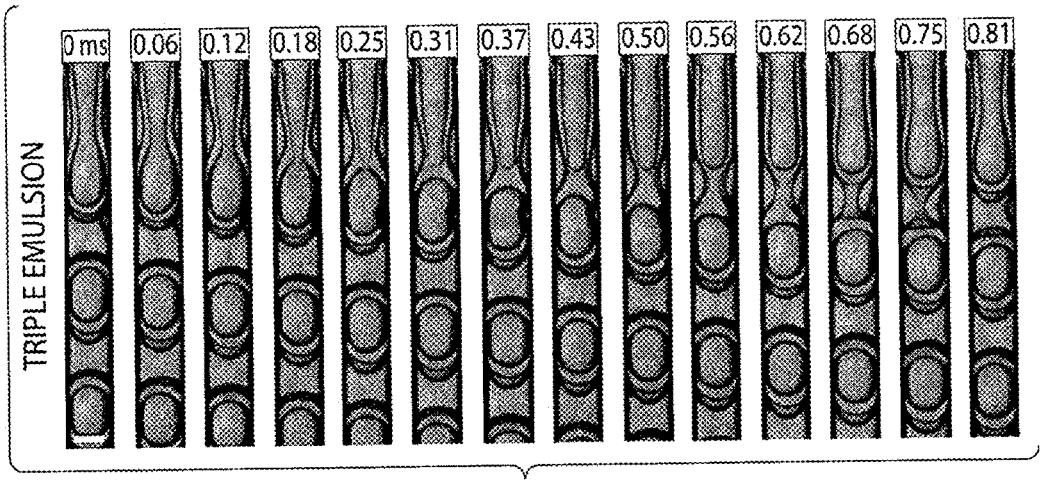

One-step formation can also be used to create higher-order multiple emulsions. To illustrate this, a triple emulsion device was constructed using three flow-focus junctions in series. To form W/O/W/O triple emulsions, the device wettability was patterned so that the first junction was hydrophobic, the second junction was hydrophilic, and the third junction was hydrophobic. Water, HFE-7500, water, and HFE-7500, all with surfactants, were injected into the device in the first, second, third, and fourth inlets, at flow rates of 4000 microliters/h for the inner phase, 3000 microliters/h for the first middle phase, 3000 microliters/h for the second middle phase, and 7500 microliters/h for the continuous phase, respectively. This ensured that $\{We_{in}, Ca_{out}\}>1$ for the first two junctions and $\{We_{in}, Ca_{out}\}<1$ for the second, so that only one dripping instability was present. This created a triple jet in the third junction, in which a water jet is surrounded by an oil jet, which is surrounded by another water jet, which is surrounded by the oil continuous phase, as shown in FIG. 5B. As with the double jet, the triple jet narrowed when it entered the junction. This caused the inner jet to break, t=250 microseconds, then the middle jet to break, t=625 microseconds, then the outer jet to break, t=750 microseconds, producing a triple emulsion, as shown in FIG. 5B. One step formation of this type thus included a series of pinching events for each of the jets as they reached an unstable width.

Example 3

Figure 7A:
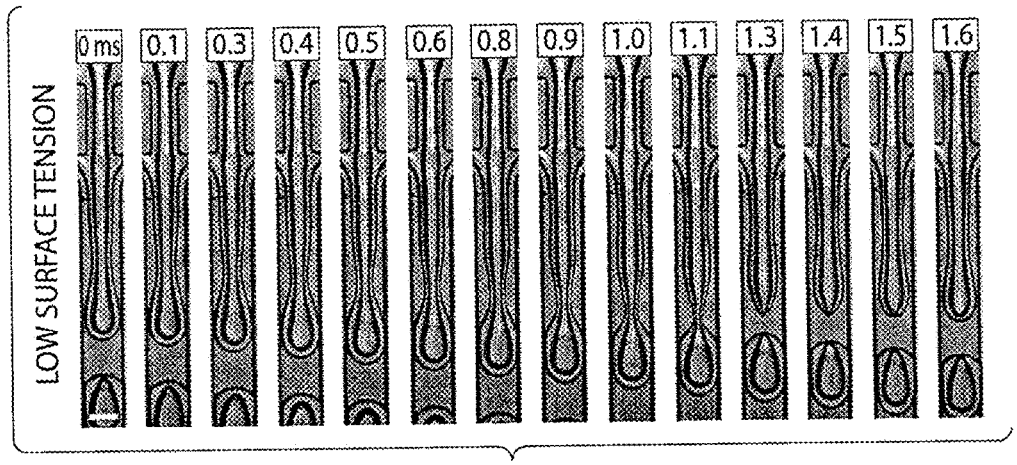
FIGS. 7A-7B show various optical microscopy images illustrating the formation of emulsions including fluids having low surface tensions or viscoelastic fluids, according to certain embodiments of the invention.

A different kind of one-step formation was found to occur when the inner jet was more stable than the outer jets. This occurred when the inner phase was composed of a fluid that formed very stable jets, either because it was very viscous, viscoelastic, or had a low surface tension. To illustrate this kind of one-step formation, the inner phase of the double jet was replaced with octanol in this example. Octanol has a very low surface tension with water, relative to air, allowing it to form very stable jets, and making it very difficult to emulsify with other microfluidic techniques. By injecting it in as the inner phase into the double flow-focus device, a double jet was produced in which the inner jet was more stable than the outer jet, FIG. 7A. As the outer jet began to pinch into a drop, it squeezed on the inner jet, thereby causing it to pinch into drops. This produced a double emulsion with an octanol drop at its core, as shown in FIG. 7A.

Because a dripping instability was used to break the double jet, the double emulsions were monodisperse, as are the octanol drops at their cores. This, in essence, allows a "difficult" fluid like octanol to be emulsified controllably by wrapping it in a fluid that is easier to emulsify. This can also be applied to other difficult fluids, such as viscoelastic polymer fluids. These fluids are needed when templating particles or capsules from emulsions formed in microfluidic devices; however, due to their viscoelastic properties, they can be difficult to emulsify controllably, because as the viscoelastic jet is sheared to break off a drop, its viscosity increases, resisting drop formation. However, by wrapping the viscoelastic jet in a water jet, it too can be emulsified controllably.

Figure 7B:
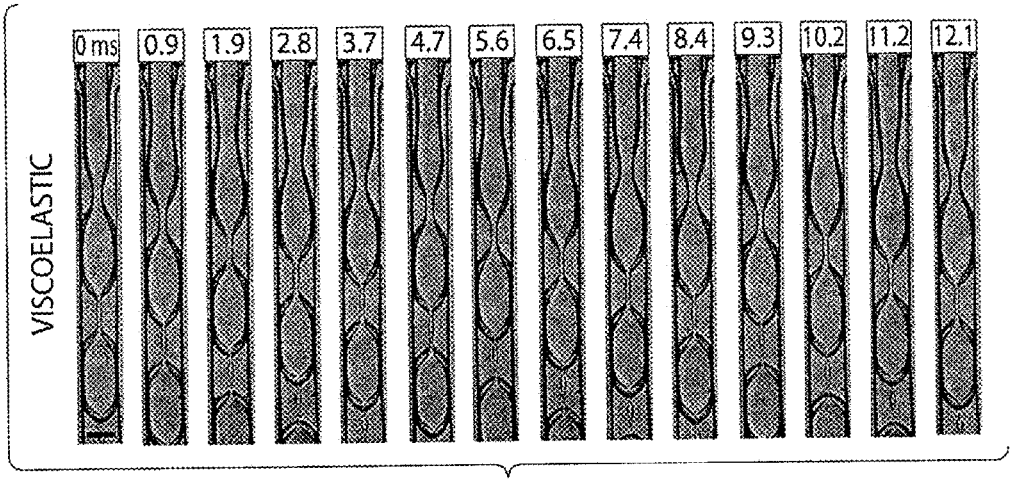

This was experimentally demonstrated using a polyethylene glycol (PEG) ($M_w$=5000 g/mol) at a concentration of 10 wt % in water. As the water jet pinched into a drop, it pinched the viscoelastic jet into a drop, as shown in FIG. 7B. This produced double emulsions with viscoelastic drops at their cores. The double emulsions can also be broken to release their cores, yielding a monodisperse population of viscoelastic drops.

Figure 8A:
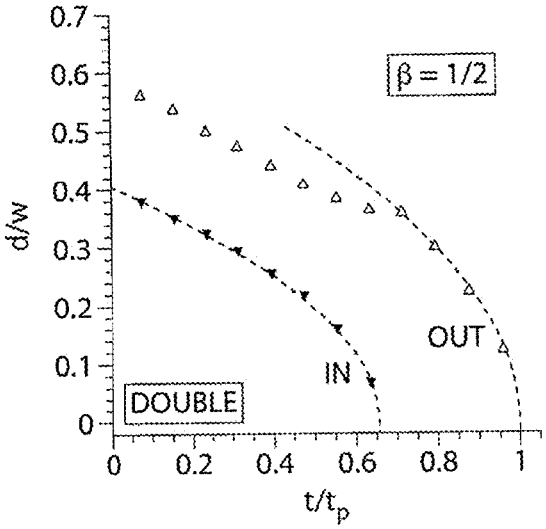
FIGS. 8A-8D illustrate jet diameter as a function of time during a one-step formation process in accordance with still another embodiment of the invention.

To quantify the dynamics of these different one-step pinching processes, the jet widths were measured as a function of time during pinch off. Early in the pinching process, the inner and outer jets narrowed in unison, as shown in FIG. 8A. When the inner jet reaches an unstable width, it breaks, rapidly narrowing and forming a drop. Interestingly, this coincides with a slight widening of the outer jet, showing that additional middle phase rushes into the void left by the collapse of the inner jet, as shown in FIG. 8A.

Figure 8C:
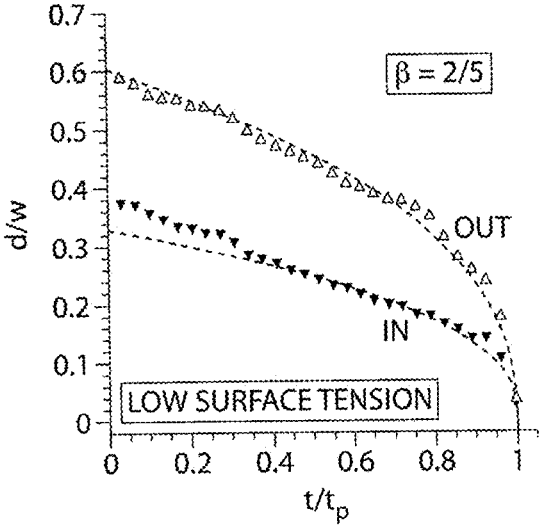
Figure 8B:
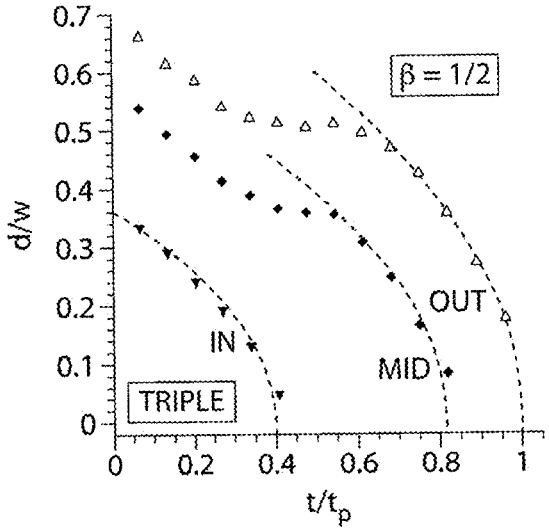

Eventually, the outer jet also collapses, forming a double emulsion. In the case of the triple emulsion, this was followed by another widening and then collapse of the third jet, as shown in FIG. 8B. The functional form of the collapse for the inner and outer jets is the same, and appeared to fit a power law with an exponent of ½. This is consistent with the breakup of a single jet due to Rayleigh-Plateau instability, suggesting that multi-jet breakup of this type occurs in a sequence of independent pinch offs.

Figure 8D:
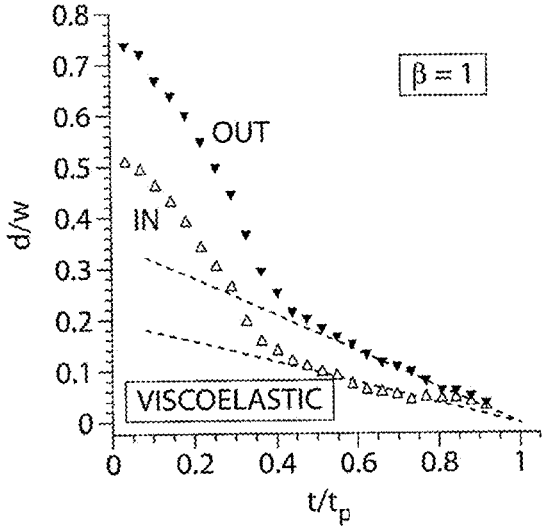

When the inner jet was more stable than the outer jet, the pinching dynamics were different. In the case of the octanol jet, there was a prolonged narrowing of both jets, followed by a sudden collapse, as shown in FIG. 8C. The functional form of the collapse of these jets could also be fit to a power law, but with an exponent of 2/5. This indicated that the pinching dynamics were more complex, potentially involving interactions between the inner and outer jets. In the case of the viscoelastic jet, the collapse was much slower; again, there was a prolonged narrowing, but this time it was followed by a very slow collapse, due to the viscoelastic response of the inner jet, as shown in FIG. 8D. These collapses also fit power laws, but this time the exponents were greater than 1; in contrast to the other jets, the collapse of these jets decelerated on approach to the pinch off, as shown in FIG. 8D. This shows that although one-step formation can produce monodisperse double emulsions with a variety of fluids, the dynamics of the pinch off process depend on the fluid properties. When the inner phase was composed of a fluid that formed very stable jets, the inner and outer phases broke at the same time, as they do when the inner jet (FIG. 8C) had a low surface tension or (FIG. 8D) was viscoelastic. All collapses in FIG. 8 fit to power laws, with exponents β (beta) shown.

Accordingly, these examples have shown that multiple emulsions can be formed in microfluidic devices in different processes by controlling dripping instabilities. If multiple instabilities are present, the emulsions are formed in a multi-step process, whereas if one is present, they are formed in a one-step process. An advantage to the one-step process is that it allowed the shell thicknesses of the multiple emulsions to be controlled over a wide range. This should be useful for applications such as particle or capsule synthesis. One-step formation also allows monodisperse drops to be formed from fluids that are normally very difficult to emulsify, such as viscoelastic fluids. This should be useful for creating new kinds of particles with microfluidics, for example, requiring emulsification long-chained polymer fluids, which are often viscoelastic.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A method, comprising:

(a) providing a microfluidic device comprising a main microfluidic channel, at least one first side microfluidic channel, and at least one second side microfluidic channel;

(b) providing a first fluid in the main microfluidic channel;

(c) flowing the first fluid to a first intersection of the main microfluidic channel and the at least one first side microfluidic channel comprising a second fluid to cause the first fluid to become surrounded by the second fluid in the main microfluidic channel without causing the first fluid or the second fluid to form separate droplets;

(d) flowing the first fluid and the second fluid in the main microfluidic channel to a second intersection of the main microfluidic channel and the at least one second side microfluidic channel comprising a carrying fluid to cause the second fluid to become surrounded by the carrying fluid without causing the first fluid or the second fluid to form separate droplets; and (e) generating a monodisperse double emulsion in the main microfluidic channel, wherein the monodisperse double emulsion is generated downstream of the second intersection, wherein the monodisperse double emulsion comprises the carrying fluid surrounding an outer fluidic droplet of the second fluid, wherein the outer fluidic droplet contains an inner fluidic droplet of the first fluid;

wherein the first fluid is immiscible with the second fluid and the second fluid is immiscible with the carrying fluid;

wherein the main microfluidic channel has (i) a first average cross-sectional dimension upstream of the second intersection between the first intersection and the second intersection and a (ii) second average cross-sectional dimension downstream of the second intersection; and wherein the second average cross-sectional dimension is between about 5% and about 20% greater than the first average cross-sectional dimension.

2. The method of claim 1, wherein the first fluid is a first aqueous fluid, the second fluid is an oil, and the carrying fluid is a second aqueous fluid, and wherein the monodisperse double emulsion is a water-in-oil-in-water (w/o/w) emulsion.

3. The method of claim 2, wherein the first fluid and the carrying fluid have the same composition.

4. The method of claim 2, wherein the first fluid and the carrying fluid have a different composition.

5. The method of claim 1, wherein the first fluid is a first oil, the second fluid is an aqueous fluid, and the carrying fluid is a second oil, and wherein the monodisperse double emulsion is an oil-in-water-in-oil (o/w/o) emulsion.

6. The method of claim 5, wherein the first fluid and the carrying fluid have the same composition.

7. The method of claim 5, wherein the first fluid and the carrying fluid have a different composition.

8. The method of claim 1, wherein the main microfluidic channel has a first hydrophilicity upstream of the second intersection and a second hydrophilicity downstream of the second intersection; and wherein the second hydrophilicity is different than the first hydrophilicity.

9. The method of claim 1, wherein the first fluid and the second fluid flow substantially collinearly in the main microfluidic channel upstream of the second intersection.

10. The method of claim 9, wherein the first fluid, the second fluid, and the carrying fluid flow substantially collinearly in the main microfluidic channel downstream of the second intersection.

11. The method of claim 1, wherein the first fluid has a surface tension of no more than about 40 mN/m (millinewtons per meter).

12. The method of claim 1, wherein the second fluid has a surface tension at least about 2 times greater than a surface tension of the first fluid.

13. The method of claim 1, wherein the first fluid comprises a viscosity of at least about 15 mPa s (millipascal-second).

14. The method of claim 1, wherein the first fluid is a viscoelastic fluid.

15. The method of claim 1, wherein the first fluid comprises a Young's modulus of at least about 0.01 GPa (gigapascal).

16. The method of claim 1, wherein at least one of the first fluid, the second fluid, and the carrying fluid comprises at least one of a chemical, biochemical, or biological entity.

17. The method of claim 1, wherein the inner fluidic droplet or the outer fluidic droplet comprises a particle.

18. The method of claim 1, wherein the inner fluidic droplet or the outer fluidic droplet comprises a cell.

19. The method of claim 1, wherein the inner fluidic droplet or the outer fluidic droplet comprises a nucleic acid molecule.

* * * * *